US011532211B2

(12) United States Patent
Acres

(10) Patent No.: US 11,532,211 B2
(45) Date of Patent: Dec. 20, 2022

(54) METHOD AND APPARATUS FOR TRIGGERING A BONUS

(71) Applicant: Acres Technology, Las Vegas, NV (US)

(72) Inventor: John F. Acres, Las Vegas, NV (US)

(73) Assignee: Acres Technology, Las Vegas, NV (US)

( * ) Notice: Subject to any disclaimer, the term of this patent is extended or adjusted under 35 U.S.C. 154(b) by 175 days.

(21) Appl. No.: 17/136,143

(22) Filed: Dec. 29, 2020

(65) Prior Publication Data

US 2021/0118263 A1 Apr. 22, 2021

Related U.S. Application Data

(63) Continuation of application No. 16/144,186, filed on Sep. 27, 2018, now Pat. No. 10,909,810, which is a continuation of application No. 15/471,752, filed on Mar. 28, 2017, now Pat. No. 10,109,153, which is a continuation of application No. 13/291,006, filed on Nov. 7, 2011, now Pat. No. 9,633,512.

(51) Int. Cl.
*G07F 17/32* (2006.01)

(52) U.S. Cl.
CPC ..... *G07F 17/3267* (2013.01); *G07F 17/3258* (2013.01); *G07F 17/3272* (2013.01)

(58) Field of Classification Search
CPC ..... G07F 17/3258; G07F 17/3267; G07F 17/3272
See application file for complete search history.

(56) References Cited

U.S. PATENT DOCUMENTS

| | | | |
|---|---|---|---|
| 5,876,284 | A | 3/1999 | Acres |
| 5,927,714 | A | 7/1999 | Kaplan |
| 6,375,567 | B1 | 4/2002 | Acres |
| 6,800,026 | B2 | 10/2004 | Cannon |
| 6,832,956 | B1 | 12/2004 | Boyd et al. |
| 6,939,229 | B2 | 9/2005 | McClintic |
| 7,077,744 | B2 | 7/2006 | Cannon |
| 7,160,190 | B2 | 1/2007 | Baerlocher et al. |
| 7,824,264 | B2 | 11/2010 | Bartholomew et al. |
| 8,075,396 | B2 | 12/2011 | Roemer |
| 8,512,131 | B2 | 8/2013 | Iddings et al. |
| 9,633,512 | B2 | 4/2017 | Acres |
| 2003/0125100 | A1 | 7/2003 | Cannon |
| 2004/0198487 | A1 | 10/2004 | Schneider |
| 2004/0214628 | A1 | 10/2004 | Boyd et al. |

(Continued)

FOREIGN PATENT DOCUMENTS

| | | | |
|---|---|---|---|
| AU | 754689 | B2 | 11/2002 |
| WO | 2007087156 | A2 | 2/2007 |

*Primary Examiner* — Reginald A Renwick
(74) *Attorney, Agent, or Firm* — Ballard Spahr LLP

(57) ABSTRACT

Embodiments of the present invention are directed to a bonus game that is common to a bank of electronic gaming devices. One or more pools accrue with each wager placed. A player qualifies to play the bonus game when at least one tracked player or game criterion, such as wagers made, exceeds a threshold, triggers a mystery-jackpot counter, or is selected by a weighted pay table. The bonus game includes a video display of a wheel bouncing against a brick wall with bricks being exploded by coins. After an opening is formed in the wall and the wheel escapes, a wheel spin determines the bonus game outcome. More than one player may play the bonus game in sequence until the last player spins the wheel.

20 Claims, 16 Drawing Sheets

(56) References Cited

U.S. PATENT DOCUMENTS

| | | | |
|---|---|---|---|
| 2006/0035705 | A1 | 2/2006 | Jordan et al. |
| 2006/0287043 | A1 | 12/2006 | Englman et al. |
| 2007/0060317 | A1 | 3/2007 | Martin |
| 2007/0167208 | A1 | 7/2007 | Acres |
| 2007/0167217 | A1 | 7/2007 | Kaminkow et al. |
| 2008/0176647 | A1 | 7/2008 | Acres |
| 2008/0207304 | A1 | 8/2008 | Acres |
| 2009/0011826 | A1 | 1/2009 | Acres |
| 2009/0017906 | A1 | 1/2009 | Jackson |
| 2009/0247267 | A1 | 10/2009 | Acres |
| 2010/0304825 | A1 | 12/2010 | Davis et al. |
| 2011/0092271 | A1 | 4/2011 | Nguyen |
| 2011/0117982 | A1 | 5/2011 | Nguyen |
| 2013/0157741 | A1 | 6/2013 | Pacey et al. |
| 2017/0200348 | A1 | 7/2017 | Acres |
| 2019/0026990 | A1 | 1/2019 | Acres |

METHOD AND APPARATUS FOR TRIGGERING A BONUS

CROSS REFERENCE TO RELATED APPLICATION

This application is a continuation of U.S. patent application Ser. No. 16/144,186 filed Sep. 27, 2018, which is continuation of U.S. patent application Ser. No. 15/471,752 filed Mar. 28, 2017, now U.S. Pat. No. 10,109,153 issued Oct. 23, 2018, which is a continuation of and claims priority to U.S. patent application Ser. No. 13/291,006 filed Nov. 7, 2011, now U.S. Pat. No. 9,633,512 issued Apr. 25, 2017, which is incorporated herein by reference in its entirety.

FIELD OF THE INVENTION

This disclosure relates generally to linked groups of electronic gaming devices and more particularly to implementing a bonus feature on such a linked group.

BACKGROUND

It is known to link a group of electronic gaming devices, such as slot machines, to a common bonus game. One such bonus game is a mystery jackpot. In a typical mystery jackpot, a number is randomly selected between upper and lower limits. After doing so, a predetermined percentage of each wager on the linked slot machines goes to a pool that is used to pay a mystery award. There may be several pools of varying sizes that accumulate simultaneously, each with its own random number selected between upper and lower limits.

Each credit played increments a counter starting from the lower limit. The machine that causes the count to meet or exceed the random number is awarded the accumulated pool. While this creates added incentive to play, there are disadvantages. Sometimes players are not aware why they have won or even that they have won a mystery award. In addition, play on the gaming devices tends to decrease immediately after a mystery award. In other words, players suspend playing to permit the mystery jackpot pool(s) to be built up and begin playing after the pool has been refreshed and after the odds for winning the mystery jackpot have increased.

DETAILED DESCRIPTION

Figure 1:
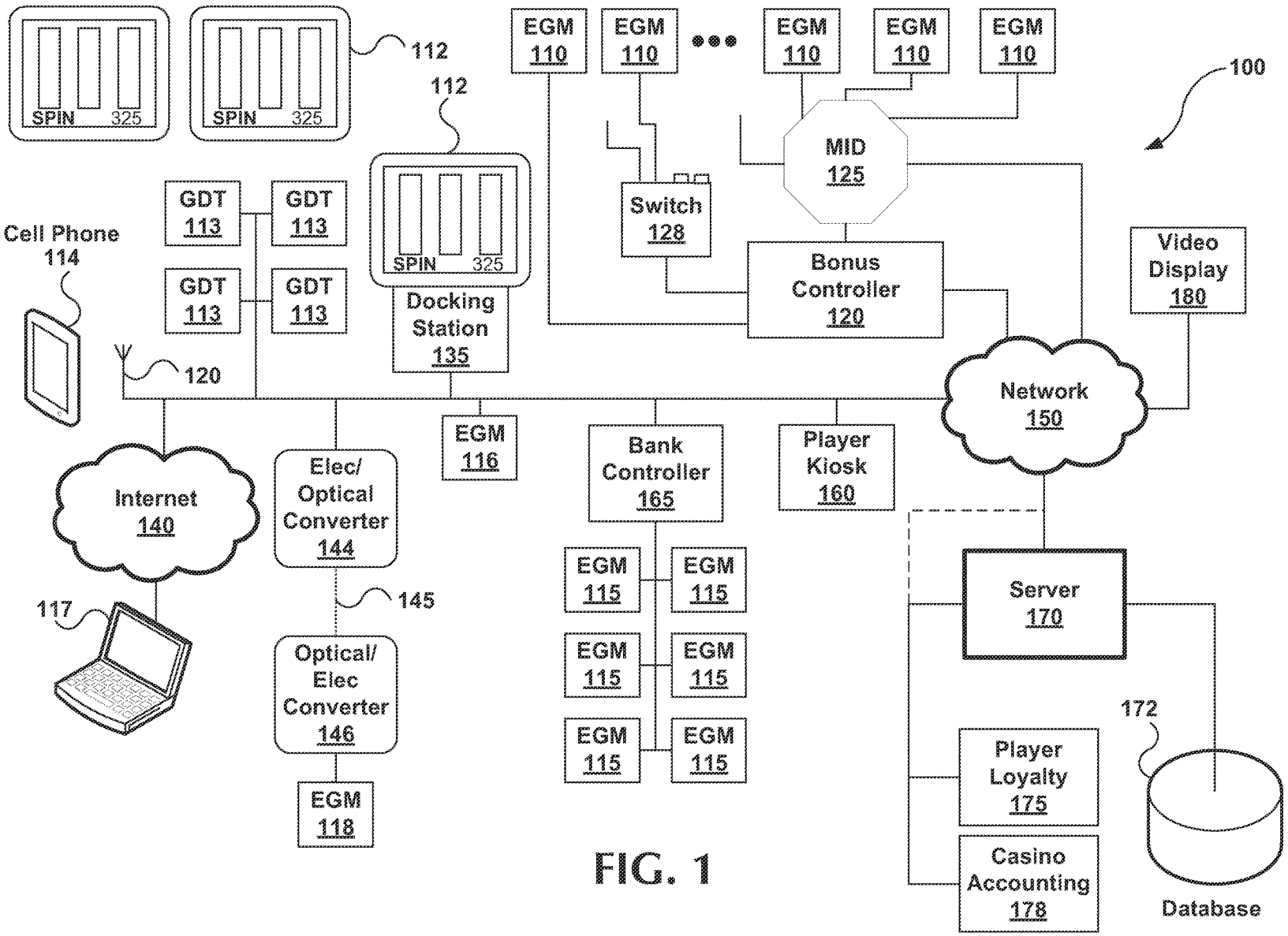
FIG. 1 is a system diagram illustrating various components of a gaming system according to embodiments of the invention.

FIG. 1 is a system diagram illustrating various components of a gaming system 100 according to embodiments of the invention. Although many different components of a possible gaming system 100 are shown in FIG. 1, various embodiments of this concept may include gaming systems that have only some of the components shown in FIG. 1. Further, additional components may be present in various embodiments of these gaming systems that are not shown in FIG. 1. These additional elements may be well known parts or devices that may be used to construct gaming systems. These additional parts or devices are not shown in FIG. 1 for the sake of clarity.

Referring to FIG. 1, the gaming system 100 includes a variety of different types of gaming devices 110, 112, 113, 114, 115, 116, 117, 118. These gaming devices 110, 112, 113, 114, 115, 116, 117, 118 include electronic gaming devices (EGMs) 110, 115, 116, 118, gaming device terminals (GDTs) 112, 113, cell phones or other mobile gaming devices 114, and personal computers 117. For ease of understanding, these gaming devices 110, 112, 113, 114, 115, 116, 117, 118 are generically referred to as gaming devices "111" or gaming devices 110-118. The term gaming devices 111, however, may refer to any combination of one or more of gaming devices 110, 112, 113, 114, 115, 116, 117, 118. Specific types of gaming devices will be referred to by their illustrated reference numerals. As discussed above, embodiments of a gaming system 100 may include one or more of the various types of gaming devices 111.

In general, a gaming network 150 connects any of a number of gaming devices 111 for central management. Various aspects of this central management may be served by a connected server 170, one or more databases 172, a player loyalty system 175, and/or a casino accounting system 178. These central management functions may, for example, include player loyalty/tracking functions, bonusing systems, player credit account management, server-centric game management, casino record keeping, player behavior analysis, tournament management, promotional game systems, ticketing systems such as Ticket-In-Ticket-Out (TITO) systems, etc. In some embodiments there may be multiple servers 170 and databases 172 to operate the systems 175, 178 and perform different functions. In other embodiments, functions may be combined and operate on a single or small group of servers 170, each with their own database 172 or combined databases. For example, the player loyalty system 175 and/or casino accounting system 178 may include separate servers directly connected to the network 150 (as shown by the dashed line), or managed through one or more other servers 170 connected to the network. In addition to these managerial functions, the network 150 may provide a communication connection between multiple gaming devices 111 for various types of game play such as community-based gaming models, head-to-head play, and tournament play.

The network 150 may include serial or parallel signal transmission lines and carry data in accordance with data transfer protocols such as Ethernet transmission lines, Rs-232 lines, firewire lines, USB lines, or other communication protocols. Although not shown in FIG. 1, substantially the entire network 150 may be made of fiber optic lines or may be a wireless network utilizing a wireless protocol such as IEEE 802.11 a, b, g, or n, Zigbee, RF protocols, optical transmission, near-field transmission, or the like.

As mentioned above, various types of gaming devices 111 may be connected to the gaming network 150. Electronic gaming devices (EGMs) 110, 115, 116, 118 may include mechanical reel slot machines, video slot machines, video poker gaming devices, video blackjack machines, keno games, multiplayer gaming devices, table games with electronic components (such as automatic card readers, chip readers, and chip counters, for example), and any other type of device that may be used to wager monetary-based credits on a game of chance. These gaming devices 110, 115, 116, 118 may have general shapes and orientations that are familiar to players, although new cabinet designs or game artwork may visually differentiate them from known machines.

Some of the EGMs 116 may be directly connected to the network 150 without any intervening hardware, other than hardware that is built into the EGM 116 to connect it to the network 150. Other EGMs 110, 115, 118 may have one or more intermediary system components coupling them to the network. For example, multiple gaming devices 115 may be arranged in a group or bank of machines and be coupled to the network 150 through a bank controller 165. The bank controller 165 may be used for compatibility purposes, for local organization and control, or for signal buffering purposes. Other gaming devices 118 may be connected to the network through one or more optical lines 145. These gaming devices 118 may, for example, be remote gaming devices in a different location or casino. The optical lines 145 may be coupled to the gaming network 150 through an electronic to optical signal converter 144 and may be coupled to the gaming devices 118 through an optical to electronic signal converter 146.

Some of the EGMs 110 connect to the gaming network 150 through a Machine Interface Device, MID 125. In general, the MID 125 is a multi-protocol interface that monitors communication between the gaming network 150 and the EGM 110. In some embodiments, the MID 125 communicates to the EGM 110 through a standard gaming network port, using a standard gaming network protocol, SAS, which is well known in the gaming industry. Most modern games include at least one communication port, which is commonly a SAS port or a port for another communication protocol.

Other EGMs 110 connect to the gaming network 150 through a bonus controller 120, which may be coupled between the gaming network 150 and gaming device 110. The bonus controller 120 generally communicates through a non-SAS protocol, such as another well-known communication protocol known as GSA. GSA is typically carried over an Ethernet network, and thus the bonus controller 120 includes an Ethernet transceiver. Because the bonus controller 120 communication may be Ethernet based, a switch 128 may be used to extend the number of devices that may be coupled to the bonus controller 120. The bonus controller 120 and/or the MID 125 may create or convert data or information received according to a particular protocol, such as SAS, into data or information according to another protocol, such as GSA. In this way the MID 125 and bonus controller 120 are equipped to communicate, seamlessly, between any EGM 110 and gaming network 150 no matter which communication protocols are in use. Further, because the MID 125 and bonus controller 120 are programmable, and include multiple extensible communication methods, as described below, they are capable of communicating with EGMs 110 that will communicate using protocols and communication methods developed in the future.

While EGMs 110, 115, 116, 118 typically include game firmware located at the gaming device itself, gaming device terminals, GDTs 112, 113 have game operating firmware located at a remote central gaming server, CGS 170. Having a central gaming server 170 control at least some part of game play on GDTs 112, 113 is referred to as server-centric system architecture. The game device terminals 112, 113 may include wireless GDTs 112 and gaming devices terminals 113 physically connected to the network 150. The wireless GDTs 112 may be connected to the network 150 via a wireless antenna 120, connected to the network through an Internet-based or cellular phone system, or connected to the network by being physically connected to a docking station 135 linked to the network. The wireless GDTs 112 may be handheld wireless computing devices configured to connect to the central gaming sever 150 and operate a plurality of game types from a library of available games. An example of a wireless GDT 112 is discussed below with respect to FIG. 5. The physically-connected GDTs 113 may be wireless GDTs that have been hard-wired to a particular location, traditional gaming devices that are acting as gaming device terminals, or any other type of gaming device that is physically connected to the network 150 and has game play at least partially controlled by a remote server 170.

The central gaming server 170 may be connected to a database 172, as well as a player club/loyalty system 175 and/or a casino accounting system 178. Additionally, although not shown in FIG. 1, the CGS 170 may be connected to a separate credit account system that manages player credit accounts. In some embodiments, the database 172 may store player credit account information. Here, the central gaming server 170 may also help manage credit transactions between the database 172 and the gaming device terminals 112, 113.

The central gaming server 170 may be implemented on variety of computing devices or systems in various embodiments depending on the scope and requirements of the server-centric gaming system. For example, in basic systems, the CGS 170 may include only a single computing device with a processor and memory storage; while in more complex gaming systems, the CGS may include multiple server racks with powerful multi-core processors and associated memory storage hardware.

Additionally, the gaming system 100 may include and support other non-traditional gaming devices such as cellular or cell phones 114 connected through a wireless antenna 120 or other wireless connection and personal computers 117 connected through the Internet 140. These types of gaming devices may be configured as gaming device terminals as described above for security purposes, although some configurations may include the installation of game software on these gaming devices. Cell phones 114 and personal computers 117 may also be used with the gaming system 100 to accomplish non-gaming functions, such as management of a player account or player credit account, accessing casino services, or playing a non-monetary demo of a game.

A community video display 180 may also be included in the gaming system 100 and coupled to the gaming network 150. The community video display 180 may be used to show bonuses, promotions, or other information to players at multiple gaming devices 111 or other people in the vicinity of the display. For example, a bank of gaming devices 111 may share a centralized video display 180 to show a bonus game that one or more of the gaming devices in the bank is participating in. In another example, the video display 180 may be used to show a casino-wide progressive jackpot to players using wireless gaming terminals in a casino restaurant. The community video display 180 may be directly coupled to the gaming network 150 as shown in FIG. 1 or may be coupled through a bonus controller 120, bank controller 165, gaming device 111, or other device to the network. The content shown on the community video display 180 may be controlled by gaming server 170, by a bonus controller 120, by a bank controller 165, or by one or more of the gaming devices 111.

A player kiosk 160 may also be directly coupled to the gaming network 150. The player kiosk 160 allows players, managers, or other personnel to access data on the gaming network 150, such as a player tracking record, and/or to perform other functions using the network. For example, a player may be able to check the current holdings of the player credit account, transfer balances, redeem player points for credits, cash, or other merchandise or coupons, such as food or travel coupons, for instance.

In some embodiments, the network 150, server 170, and database 172 may be dedicated to communications regarding specific game or tournament play. In other embodiments, however, the network 150, server 170, and database 172 may be part of a player loyalty or tracking network. For player loyalty capabilities, when a player inserts a player loyalty card in the card reader of a gaming device or otherwise identifies herself to the gaming device, player data is sent over the network 150 to a player loyalty server 170, where the player identification information is compared to player information records in the player database 172 to provide the player with information regarding their player account or other features at the gaming device 111 where the player is wagering. Additionally, multiple databases 172 and/or servers 170 may be present and coupled to one or more networks 150 to provide a variety of gaming services, such as both game/tournament data and player data. The recorded player data can be used by the casino to provide additional benefits to players, such as extra bonuses or extra benefits such as bonus games and other benefits as described above.

A player typically plays the gaming device 111 by placing a wager and activating an input mechanism to initiate a game associated with the placed wager. As used herein, a gaming event refers to any activity that affects the calculation or display of a game outcome. Game events include interactions occurring between the gaming device 111, the player, and/or a connected game system. Example gaming events include a player inserting a player account card in a gaming device, a double-pay bonus time period activation, a first spinning reel coming to a stop, a player's input to hold a card in a poker hand, etc. A game refers to the calculation and completion of one game outcome. That is, a game includes a single game cycle that begins with the initiation of the wagered upon game and ends with the completion of all activities relating to the wager placed including any intervening bonuses. In other words, a game encompasses all gaming events dependent on a placed wager during an initiated game including all amounts due the player that are paid directly by the gaming machine, or as a manual payment by casino personnel to the player playing that gaming machine. For example, if an item was awarded as a result of a wager that could be saved and used later, the game would encompass the awarding of the item, which is part of the game outcome, but not the later use of that item since the later use would affect a different game outcome. A game session refers to one or more played games. For example, a game session for a particular player may include each game played on a specific gaming device, each game played between insertions of money or credits, each game played between an initial money or credit insertion and a cash-out or zeroing out of credits, each game played during a casino stay, or each game played over a predetermined time period. Alternatively, game sessions may refer to games played by multiple players over a specified time period or event period with respect to a particular gaming device or group of gaming devices.

In general, a player operates a gaming device 111 to play a game by inserting or transferring a starting credit to a gaming device and activating a gaming initiating button or other input. Depending on the type of gaming device being played, decisions about game outcomes may be carried out locally at the game device 111, such as with EGMs, 110, 115, 116, 118, or at a central gaming server 170, such as with GDTs 112, 113. In either case, the gaming device 111 may send some data through its SAS or other data communication port through the gaming network 150 to various servers 170, systems 175, 178, and databases 172 to collect information about the game play on the gaming devices, such as wagers made, results, various pressing of the buttons on the gaming devices, for example. In gaming devices 110 coupled through the MID 125 and/or bonus controller 120, some of this sent data may be collected by the bonus controller 120. After a game outcome is selected, it is displayed on the gaming device to the player and any associated awards are presented to the player.

In some instances, the gaming devices 111 may accept information from systems external to the gaming device itself to cause the gaming device to perform other functions. For example, these external systems may drive the gaming device 111 to issue additional credits to the player. In another example, a promotional server 170 may direct the gaming device to print a promotional coupon on the ticket printer of the gaming device.

The bonus controller 120 may be structured to perform some of the above-described functions as well. For example, in addition to standard games on the EGM 110, the bonus controller 120 may be structured to drive the EGM 110 to pay bonus awards to the player based on any of the factors, or combination of factors, related to the EGM 110, the player playing the EGM 110, particular game outcomes of the game being played, or other factors.

In this manner, the combination of the bonus controller 120 and MID 125 are a sub-system capable of interfacing with the EGMs 110 connected to them within the gaming system 100. Through this interface, the MID 125 may gather data about the game, game play, or player, or other data on the EGM 110, and forward it to the bonus controller 120. The bonus controller 120 then uses such collected data as input and, when certain conditions are met, sends information and/or data to the EGM 110 to cause it to perform certain functions.

In a more detailed example, suppose a player is playing an EGM 110 coupled to the MID 125 and the bonus controller 120 described above. The player inserts a player loyalty card so the gaming network 150 knows the player identity. The MID 125 also stores such identifying information, or perhaps stores only information that the player is a level-2 identified player, for instance. The MID 125 passes such information to the bonus controller 120, which has been programmed to provide a welcome-back bonus to any level-2 player after he or she has played two games. Gameplay on the EGM 110 continues and, after the player plays two games, the bonus controller 120 instructs the EGM 110 to add an additional 40 credits to the EGM 110 as the welcome-back bonus. Such monitoring and control of the EGM 110 can occur in conjunction with, but completely separate from any player tracking or bonusing function that is already present on the gaming network 150. In other words, the server 170, when structured at least in part as a bonusing server, may be set to provide a time-based bonus of 10 credits for every hour played by the player of the EGM 110. The above-described welcome-back bonus may be managed completely separately through the bonus controller 120 and MID 125. Further, all of the actions on the EGM 110 caused by the bonus controller 120 are also communicated to the standard accounting 178, loyalty 175, and other systems already present on the gaming network 150.

Wireless GDTs 112 may be checked out by players visiting a casino at, for example, a player assistance desk. Here, the casino may associate a unique number of the GDT 112 with an exiting player credit account upon identification of the player so that the "checked-out" GDT can place wagers from the player credit account. In other embodiments, the wireless GDT 112 may be "preloaded" with a credit total at the casino help desk in response to a player authorizing an amount of money to be transferred to the casino (e.g., handing over cash to the casino attendant, or using a credit card to access money). During game play, the player may return to the casino help desk to add additional credits to the wireless gaming device, or the player may visit a player-kiosk (cash-kiosk) 160 connected to the gaming network 150 to add additional credits to the wireless GDT 112. The player-kiosk 160 may include a bill/ticket validator to accept additional money from the player and/or may include a magnetic strip reader for accessing information about a credit/debit card used to transfer money to the wireless GDT 112. The player-kiosk 160 may also include a ticket printer or cash dispenser where a player can redeem or "cash-out" remaining credits on their wireless GDT 112. The player-kiosk 160 may also be used to enter information needed to access a player credit account or player loyalty account. Thus, the magnetic strip reader on the player-kiosk 160 may also be able to read a player loyalty/club card, or the player-kiosk may include a biometric scanner or other device capable of identifying a player.

Wireless GDTs 112 may also be purchased by a player and personalized in some gaming system embodiments. While these embodiments do not allow the casino to keep as tight of control over the game device terminals, they may allow a player to choose a preferred color scheme, graphic layout, or configuration for a wireless gaming device terminal 112. Additionally, a player may be able to use a purchased wireless GDT 112 at multiple casinos. Each casino may have a log-in process, check-in process, or other security system set in place before a wireless GDT 112 can interface with a gaming system 100, but allowing players to own a wireless GDT 112 may reduce overhead costs of buying and maintaining many GDTs to check-out to players and eliminate lines that may form on weekends or holidays to check-out a GDT. Other models of ownership, leasing, or otherwise supplying GDTs are possible in other embodiments.

Using wireless GDTs 112 in a server-centric gaming system has several advantages. One advantage is that a player may move freely about a casino property with the GDT 112 and choose what game to play and when to play it. For example, if a player visits a casino restaurant, the player may want to gamble during the time between placing and order and receiving food. With the wireless GDT 112, a player can select a game and place wagers while waiting. A casino may place limits on where a wireless GDT may be played by limiting a wireless network range, or including a location device, such as a GPS transmitter/receiver, in the gaming device terminal. This may prevent, for instance, a player taking the GDT to a nearby restaurant outside of the casino to play. Alternatively, a casino may place very little restriction on where a GDT can be played and use cell phone networks, wireless Internet networks, or other communication networks to facilitate a connection between the wireless GDT 112 and the central gaming sever 170.

In addition to configuring existing gaming device 113 to operate on a server-centric gaming system (or implementing new gaming devices configured to operate on a server-centric gaming system) a casino may use docking stations 135 to provide players a comfortable and familiar place to engage in game play. These docking stations 135 may include a gaming cabinet housing a ticket/bill validator, ticket printer, enlarged video or mechanical game displays, top boxes, and/or chairs to provide a traditional gaming experience to a player and add functionality to the a wireless game device terminal 112. The docking stations 135 may include a connection device to connect to a docking port (See FIG. 5) of a wireless game device terminal. The docking station may be connected to a player credit account system, player loyalty system 175, casino accounting system 178, and/or the central gaming sever 170. Alternatively, the docking station may use the wireless connection of the GDT 112 to connect to the central gaming server 170. Docking stations 135 will typically be directly connected to a building power supply. Thus, players may also use the docking stations 135 to recharge a wireless GDT 112 without interruption to game play.

A docking station differs from a fixed gaming device terminal connected to the server-centric gaming system in that game play data may be transferred though, or stored and retrieved on, the wireless GDT 112 that is docked at the docking station 135. Here, for example, docking stations not in use can be quickly and easily moved to reconfigure game floors without needing to update data connection configurations.

Docking stations 135 may be located around various locations within a casino so that players can choose a location they prefer to gamble. While some docking stations 135 may be configured to closely resemble conventional gaming devices, other docking stations may be configured to provide other styles of devices and game environments. For example, docking stations may be implemented in bar tops, tables, or wall portions. In one instance, a simple docking station with power and network connectivity may be implemented in a pool-side cocktail table so that a player can recharge a wireless GDT 112 while taking a quick swim, quickly download a news paper to read or TV show to watch while enjoying the sun, make reservations at a casino restaurant, and then play fifty games of video poker.

Additionally, in player-owned GDT models, docking stations 135 may provide a mechanism by which a player can validate their GDT 112, add credits to their GDT, charge their GDT, allow play with mechanical reels or a common video display, or simply provide a comfortable area to play their GDT.

Wireless gaming device terminals 112 may also provide unique and flexible arrangements for competitive or cooperative linked gaming. For example, a casino may provide an area with several couches or chairs that allow a group of players to interact with each other while playing a linked game. A common video display may be mounted nearby to show a player score chart, common game play or bonus screens, or other common game information. A linked connection screen may be implemented on the GDTs 112 to allow players to connect to one another, or connected docking stations 135 may be used to link the GDTs.

Although wireless GDTs 112 provide many flexible gaming options, existing gaming devices 113 may be used as gaming terminals in a server-centric gaming system 100 as well. Use of existing game devices 115 in a server-centric gaming system 100 may provide players with a familiar gaming experience while availing them to the advantages of the server-centric model, such as a broad library of games, player credit account flexibility, and customizable game play. Depending on the system setup desired by the casino, the existing game devices 113 may appear to play exactly the same as a stand-alone game device to players, or may provide one or more features available because of the server-centric connection to the player.

Some server-centric gaming systems 100 may have complete control over all game play on game device terminals 112, 113, where the gaming server 170 controls all game play functions on a game device. However, in other server-centric gaming systems 100, a gaming server 170 may only control a portion of game play. For ease of reference, these types of systems will be referred to as hybrid server-centric gaming systems. All references to "server-centric gaming systems" in this disclosure applies to both complete control systems and hybrid systems. Although some game play features may be carried out at a gaming device terminal 112, 113, the severing of a connection between the gaming server and the gaming device would still cause game play on the gaming device to cease. In one example, an existing mechanical reel spinning gaming device 113 may be implemented in a server-centric system where the existing game device controls the display of the game play and the game outcome in response to a random number generated at a gaming server 170 and sent to the gaming device. Here, although the actual game result may be determined at the game device level, this game result is only determined as a result of the random numbers received from the gaming server 170. That is, the gaming server 170 sends three random numbers that represent the reel stop locations for a game result. The gaming device 113 takes those random reel stop locations and determines if such a combination results in a winning game outcome associated with an award. The gaming device 113 also controls the stepper motors that drive the spinning reels to the correct stop locations.

Server-centric gaming systems have many advantages over server-based gaming systems. Some of these advantages include flexibility in implementing the system with a variety of gaming devices 112, 113, improved security over game play, ability to provide a wide array of games, ease of updating current games or adding new games, ease in accounting and other game tracking metrics, and simplicity of casino floor implementation.

The ability to provide a flexible implementation of the system over a wide variety of gaming devices 112, 113 allows for implementation with current traditional gaming devices, but unlocks the possibilities in providing gaming on mobile gaming devices and remote gaming devices, such as wireless tablets, cell phones, and personal computers (e.g., APPLE IPADs, desktop computers, laptop computers, or other personal computing devices). Additionally, the flexibility afforded by the server-centric model allows for the ability to modify or add to the gaming system with relative ease. For example, a casino may implement a relatively basic server-centric system with traditional gaming devices, and then decide after a few months to incorporate wireless gaming devices 112 to be used around the casino property into the gaming system. At still a later date, the casino could expand the system to include internet gaming or other remote types of gaming.

Improved system security is achieved by conducting decisions and control over game play at a central gaming sever 170 rather than at multiple gaming devices 111. That is, in traditional gaming systems, security over game play must be controlled and monitored for each gaming device since game play is conducted at the gaming device level. These individual gaming devices 111 may be subjected to various attacks via magnets, physical force, electric signals, or other types of intrusions that are intended to disrupt the game play results being calculated within the gaming device. With server-centric gaming, however, these intrusions have no effect on game play because it is carried out independently of the gaming device 111. Thus, for example, the casino would not have to monitor a wireless gaming device 112 that a player could take back to their hotel room and possibly disassemble. Even if the player attempted to interfere with game play on the wireless device 112, her attempts would be fruitless because the gaming device has no control over game play.

In addition, large libraries of game types may be available for the player to play. And, unlike server-based games, there is no need to wait for a significant period of time after selecting a game to play game while the complete code for the game downloads from the server to the gaming device. This makes it easier for a player to switch between games or try out a new game. Additionally, when delivering a new game, there is no need to determine if each of the connected gaming devices 112, 113 will be able to implement the game play of the new game. Rather, the new game simply needs to work with the single system on the server 170.

In a basic embodiment, a server-centric gaming system 100 needs only to include a server 170, a gaming device 112, 113, and a connection 150 between the server and the gaming device. For ease of understanding, a server in a server-centric gaming system will be referred to as a central gaming sever or CGS 170 (these terms, along with central game server or game server, are used interchangeably in this disclosure). A gaming device 112, 113 in a server-centric gaming system will be referred to as a gaming device terminal or GDT (these terms, along with game device terminal, game device, or game terminal, are used interchangeably in this disclosure). A central gaming server 170 may include many different functionalities in different embodiments, but it will be the server that controls game play at one or more gaming device terminals 112, 113. Each gaming device terminal 112, 113 acts as a terminal for interfacing with a player for game play, but does not make any decisions regarding game outcomes on its own. As discussed above, GDTs 112, 113 may take many different formats from conventional game devices under the control of a CGS to simple wireless touchscreen devices to personal computers.

As these are gaming devices 112, 113 meant to accept wagers on game play, a system is also needed to handle money or credits that may be used for placing wagers on the games of chance. Various systems of handling money/credits may be implemented with server-centric gaming systems. For ease of understanding, this disclosure will use the term "player credit account" (or PCA) to refer to all types of money/credit systems that keep track of the number of credits that a player may control.

In a server-centric gaming system 100 implemented on more traditional gaming devices that have gaming cabinets with included bill/ticket validator and ticket printers (or coin slots and coin hoppers), the player credit account may simply be a local record of the credits available on that particular gaming device terminal. That is, while control of game play may be controlled by a CGS 170, credit management may remain at the gaming device terminal level. Here, credits added via the bill/ticket validator are added to the player credit account and credits wagered or cashed out are subtracted from the player credit account. During game play, the central gaming server 170 provides instructions on adding additional credits from winning game outcomes or other bonuses. In some embodiments, the central gaming server 170 may also provide instructions for deducting credits from wagers placed at the gaming device terminal 112, 113. In other embodiments, however, the credits offered up in a wager may be deducted by the gaming device terminal 112, 113 independent of any instructions from the CGS 170. These types of player credit accounts may also be used with gaming device terminals 112, 113 that do not have a physical credit input/removal device, but allow a player to input a credit card number or other type of unique player identifier that allows money to be transferred to and from the gaming device terminal. For example, a player may use a touchscreen number pad to enter her credit card number and request $100 to be transferred to the gaming device terminal 112, 113. The GDT 112, 113 may keep track of the amounts of money wagered and won during a game session. If the player has $80 remaining on their player credit account at the GDT 112, 113 when they decide to end the gaming session, the player may again enter her credit account number (or the GDT may simply remember which credit card number was used to add credits) to transfer the remaining $80 back to her credit card account. In each of these types of systems, the player credit account is typically associated with the gaming device terminal 112, 113 that the player is playing. A player credit account may also be used with any of the other types of gaming devices 111 on the gaming system 100 even when the game system does not include server-centric architecture or GDTs 112, 113.

In server-centric gaming systems that include gaming device terminals without credit input or removal devices, an additional credit system may be implemented to facilitate a player credit account where wagers may be deducted and awards may be added. This additional credit system may be controlled by the central gaming server 170 or may be controlled by another server. The additional credit system may be a casino-wide system, may include multiple casino properties, may include GDTs 112, 113 connected through the internet on a casino system, or may be independent of any casinos. In some embodiments, the credit system may allow requested amounts of credits to be "downloaded" to a particular GDT 112, 113 for a gaming session where the internal processor and memory of the GDT handles the credits once received from the credit system. In other embodiments, the credit system may be in frequent contact with the central gaming server 170 and handle all credit reductions and additions. In each of these types of systems, the player credit account is typically associated with the player themselves rather than the gaming device terminal that the player is playing. This means that the player may have to take an additional step of associating their player credit account with a GDT 112, 113 that they are playing. This may be done automatically when a player identifies themselves with a player club card, credit card, driver's license, or other identification step. Alternatively, the player may have to provide at least one additional piece of information or identification to access a player credit account and associate it with the gaming device terminal 112, 113. In embodiments where a player "checks-out" a GDT 112, 113 from a casino services desk, the casino operator may verify the player's identity and make the necessary association with a player credit account.

In these types of systems players may add or remove credits from their player credit accounts using various methods. For example, in some systems, one or more cash-kiosks 160 may be placed on the gaming floor to allow a player to access his or her player credit account. That is, at the cash-kiosks 160, the player may add additional credits to her player credit account by inserting cash or tickets into a bill/ticket acceptor, by swiping a credit or debit card through a magnetic strip card reader, or otherwise providing information that allows money to be transferred to a specified player credit account. Additionally, the player may remove extra credits from her player credit account at the player kiosk 160 by requesting cash or transferring credits to a bank account, credit card account, or other player controlled account. Although the above example refers to a cash-kiosk 160, players may also manage their player credit accounts at a casino services desk/cashier cage or at a personal computer over the Internet 140 from home or other locations.

Server-centric systems 100 can be embodied in many different ways with various elements of control over game play being transmitted in different manners and/or at different times. For example, in one type of server-centric system 100, every bit of data appearing on the gaming device 112, 113 is sent in substantial real time. That is, if an image of a spinning reel is to be displayed on the gaming device 112, 113 in response to a game initiating input, the server 170 would transfer the animated graphic file to the gaming device terminal with instructions of which reel to show the graphic and the duration that the graphic animation should be displayed. In other types of server-centric systems 100, some graphic, sound, or other data files may be "pre-loaded" on the gaming device 112, 113 and stored in a local cache or memory on the gaming device terminal prior to game play. While all game play is still controlled by the server 170, the server does not need to constantly resend graphical or other data over the connection to the gaming device terminal 112, 113 during game play. Rather, the server 170 merely provides instructions for displaying a certain graphic sequence and the GDT 112, 113 retrieves the specified graphic file from its memory and implements as instructed by the central gaming server. These systems may have the advantage of not using as much connection bandwidth as compared to the server-centric systems with real-time control since large graphic, animation, and sound files do not need to be repeatedly transferred. Although networks allow large amounts of data to be regularly transferred, casinos having many wireless GDTs 112 in play at the same time may benefit from the decreased wireless network traffic between the GDTs and central gaming server 170.

In yet other embodiments, server-centric systems 100 may be configured to incorporate existing gaming device 113 on a casino floor. These existing gaming devices 113 include mechanical reel spinning games, video slots, video poker games, video keno, video black jack, etc. Often times, these existing games will come with gaming cabinets with specific glass graphics, reel strips, lighting configurations, top box features, etc. that lend themselves to only one or only a few game themes. Here, server-centric systems or hybrid server-centric systems may be implemented to run only the single game or only a few related games on the existing game devices. For example, on a spinning reel WHEEL OF FORTUNE game, the gaming device may simply receive random numbers from the central gaming server to determine game and bonus outcomes. Here the management of the spinning reels, the bonus wheel, the sounds and graphics of the game, etc. may all be controlled by the gaming device 113 with the server 170 only supplying the random data necessary to determine game and bonus outcomes.

Figure 2:
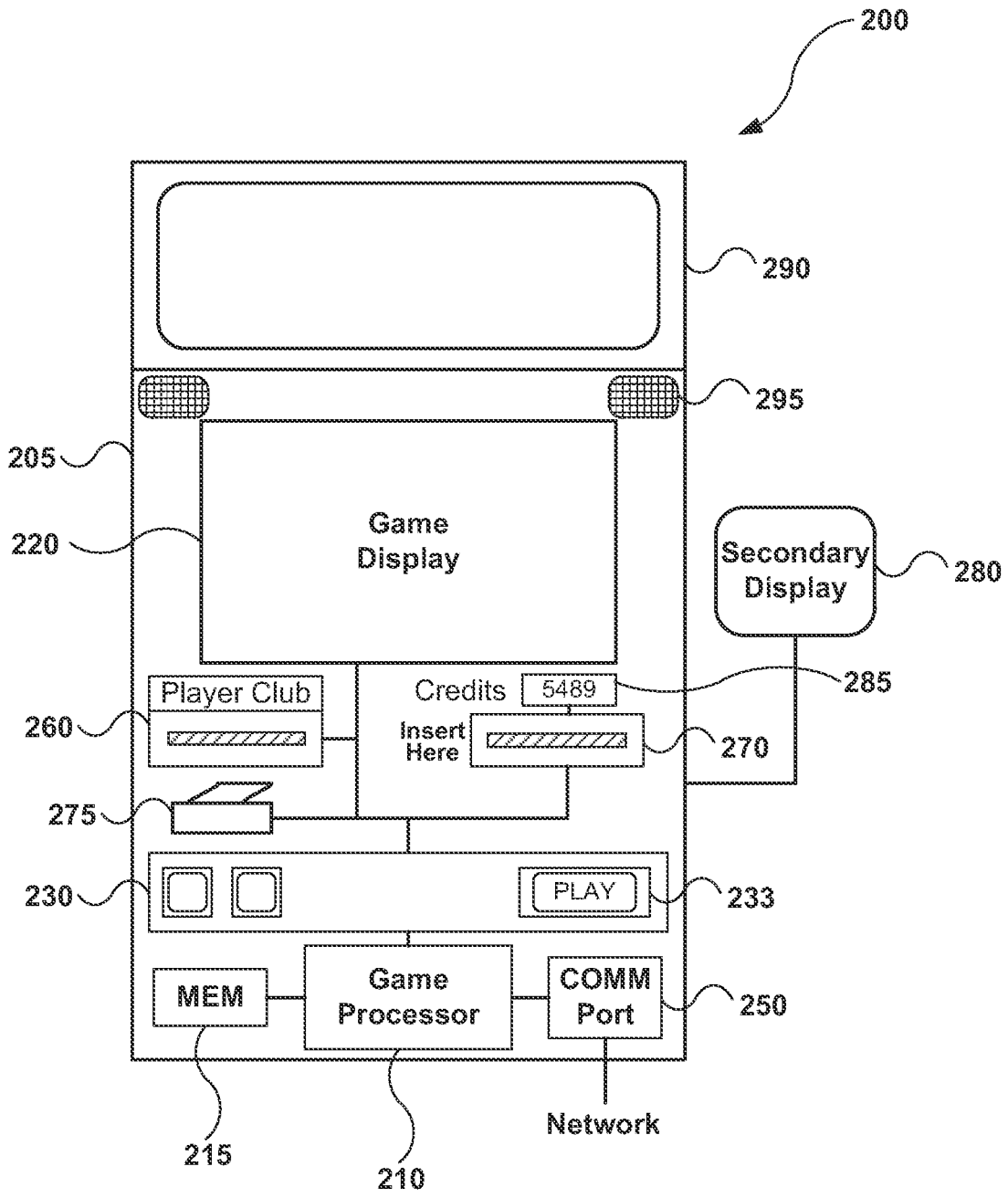
FIG. 2 is a functional block diagram that illustrates an example gaming device that can be a part of the gaming system shown in FIG. 1.

FIG. 2 is a functional block diagram that illustrates an example gaming device 200 that can be a part of the gaming system shown in FIG. 1. Referring to FIG. 2, the illustrated gaming device 200 is an example of the gaming devices 111 that are shown in FIG. 1. As discussed above, these gaming devices 111 may include all types of electronic gaming machines, such as physical reel slot machines, video slot machines, video poker gaming devices, video blackjack machines, keno games, and any other type of devices may be used to wager monetary-based credits on a game of chance. As mentioned above, various other types of gaming devices may be connected to the network 150 (FIG. 1) such as wireless gaming devices, computers used for gaming purposes, cellular phones, multi-player gaming stations, server-centric gaming device terminals, etc.

Returning to FIG. 2, the illustrated gaming device 200 includes a cabinet 205 to house various parts of the gaming device 200, thereby allowing certain components to remain securely isolated from player interference, while providing access to player input/output devices so that the player may interact with the gaming device. The securely housed components include the game processor 2100, memory 215, and connection port 250. The game processor 210, depending on the type of gaming device 200, may completely or partially control the operation of the gaming device. For example, if the gaming device 200 is a standalone gaming device, game processor 210 may control virtually all of the operations of the gaming device and attached equipment. In other configurations, the game processor 210 may implement instructions generated by or communicated from a remote server (e.g., server 170 shown in FIG. 1) or other controller. For example, the game processor 210 may be responsible for running a base game of the gaming device 200 and executing instructions received over the network 150 from a bonus server or player tracking server. In a server-centric gaming environment, the game processor 210 may simply act as a terminal to perform instructions from a remote server that is running game play on the gaming device 200.

The memory 215 is connected to the game processor 210 and may be configured to store various game information about gameplay or player interactions with the gaming device 200. This memory may be volatile (e.g., RAM), non-volatile (e.g., flash memory), or include both types of memory. The connection port 250 is also connected to the game processor 210. This connection port 250 typically connects the gaming device 200 to a gaming network, such as the gaming network 150 described above. The connection port 250 may be structured as a serial port, parallel port, Ethernet port, optical connection, wireless antenna, or any other type of communication port used to transmit and receive data. Although only one connection port 250 is shown in FIG. 1, the gaming device 200 may include multiple connection ports. As described above, in many existing gaming devices, this connection port 250 is a serial connection port utilizing a SAS protocol to communicate to one or more remote game servers, such as player tracking servers, bonus servers, accounting servers, etc.

The player input/output devices housed by the gaming cabinet 205 include a game display 220, a button panel 230 having one or more buttons 233, a ticket printer 275, a bill/ticket reader 270, a credit meter 285, a player club interface device 260, and one or more game speakers 295. Various gaming devices may include fewer or more input/output devices (e.g., a game handle, a coin acceptor, a coin hopper, etc.) depending upon the configuration of the gaming device.

The gaming display 220 may have mechanical spinning reels, a video display, or include a combination of both spinning reels and a video display, or use other methods to display aspects of the gameplay to the player. If the gaming display 220 is a video display, the gaming display may include a touch screen to further allow the player to interact with game indicia, soft buttons, or other displayed objects. The button panel 230 allows the player to select and place wagers on the game of chance, as well as allowing the player to control other aspects of gaming. For example, some gaming devices allow the player to press a button 233 to signal that he or she requires player assistance. Other buttons may bring up a help menu and/or game information. The buttons 233 may also be used to play bonuses or make selections during bonus rounds.

Ticket printers 275 have relatively recently been included on most gaming devices to eliminate the need to restock coin hoppers and allow a player to quickly cash-out credits and transfer those credits to another gaming device. The tickets can also typically be redeemed for cash at a cashier cage or kiosk. The ticket printers are usually connected to the game processor and to a remote server, such as a TITO server to accomplish its intended purpose. In gaming devices that have more than one peripheral device, and which include only a single SAS port, the peripheral devices all share communication time over the connection port 250.

Another peripheral device that often requires communication with a remote server is the player club interface device 260. The player club interface device 260 may include a reader device and one or more input mechanisms. The reader is configured to read an object or indicia identifying the player. The identifying object may be a player club card issued by the casino to a player that includes player information encoded on the card. Once the player is identified by a gaming device, the player club interface device 260 communicates with a remote player server through the connection port 250 to associate a player account with the gaming device 200. This allows various information regarding the player to be communicated between the gaming device 200 and the player server, such as amounts wagered, credits won, and rate of play. In other embodiments, the card reader may read other identifying cards (such as driver licenses, credit cards, etc.) to identify a player. Although FIG. 2 shows the reader as a card reader, other embodiments may include a reader having a biometric scanner, PIN code acceptor, or other methods of identifying a player so as to pair the player with their player tracking account. As is known in the art, it is typically advantageous for a casino to encourage a player to join a player club since this may inspire loyalty to the casino, as well as give the casino information about the player's likes, dislikes, and gaming habits. To compensate the player for joining a player club, the casino often awards player points or other prizes to identified players during game play.

Other input/output devices of the gaming device 200 include a credit meter 285, a bill/ticket acceptor 270, and speakers 295. The credit meter 285 generally indicates the total number of credits remaining on the gaming device 200 that are eligible to be wagered. The credit meter 285 may reflect a monetary unit, such as dollars, or an amount of credits, which are related to a monetary unit, but may be easier to display. For example, one credit may equal one cent so that portion of a dollar won can be displayed as a whole number instead of decimal. The bill/ticket acceptor 270 typically recognizes and validates paper bills and/or printed tickets and causes the game processor 210 to display a corresponding amount on the credit meter 285. The speakers 295 play auditory signals in response to game play or may play enticing sounds while in an "attract-mode," when a player is not at the gaming device. The auditory signals may also convey information about the game, such as by playing a particularly festive sound when a large award is won.

The gaming device 200 may include various other devices to interact with players, such as light configurations, top box displays 290, and secondary displays 280. The top box display 290 may include illuminated artwork to announce a game style, a video display (such as an LCD), a mechanical and/or electrical bonus display (such as a wheel), or other known top box devices. The secondary display 280 may be a vacuum fluorescent display (VFD), a liquid crystal display (LCD), a cathode ray tube (CRT), a plasma screen, or the like. The secondary display 280 may show any combination of primary game information and ancillary information to the player. For example, the secondary display 280 may show player tracking information, secondary bonus information, advertisements, or player selectable game options. The secondary display may be attached to the game cabinet 205 or may be located near the gaming device 200. The secondary display 280 may also be a display that is associated with multiple gaming devices 200, such as a bank-wide bonus meter, or a common display for linked gaming devices.

In operation, typical play on a gaming device 200 commences with a player placing a wager on a game to generate a game outcome. In some games, a player need not interact with the game after placing the wager and initiating the game, while in other games, the player may be prompted to interact with the gaming device 200 during game play. Interaction between the player and the gaming device 200 is more common during bonuses, but may occur as part of the game, such as with video poker. Play may continue on the gaming device 200 until a player decides to cash out or until insufficient credits remain on the credit meter 285 to place a minimum wager for the gaming device.

Figure 3:
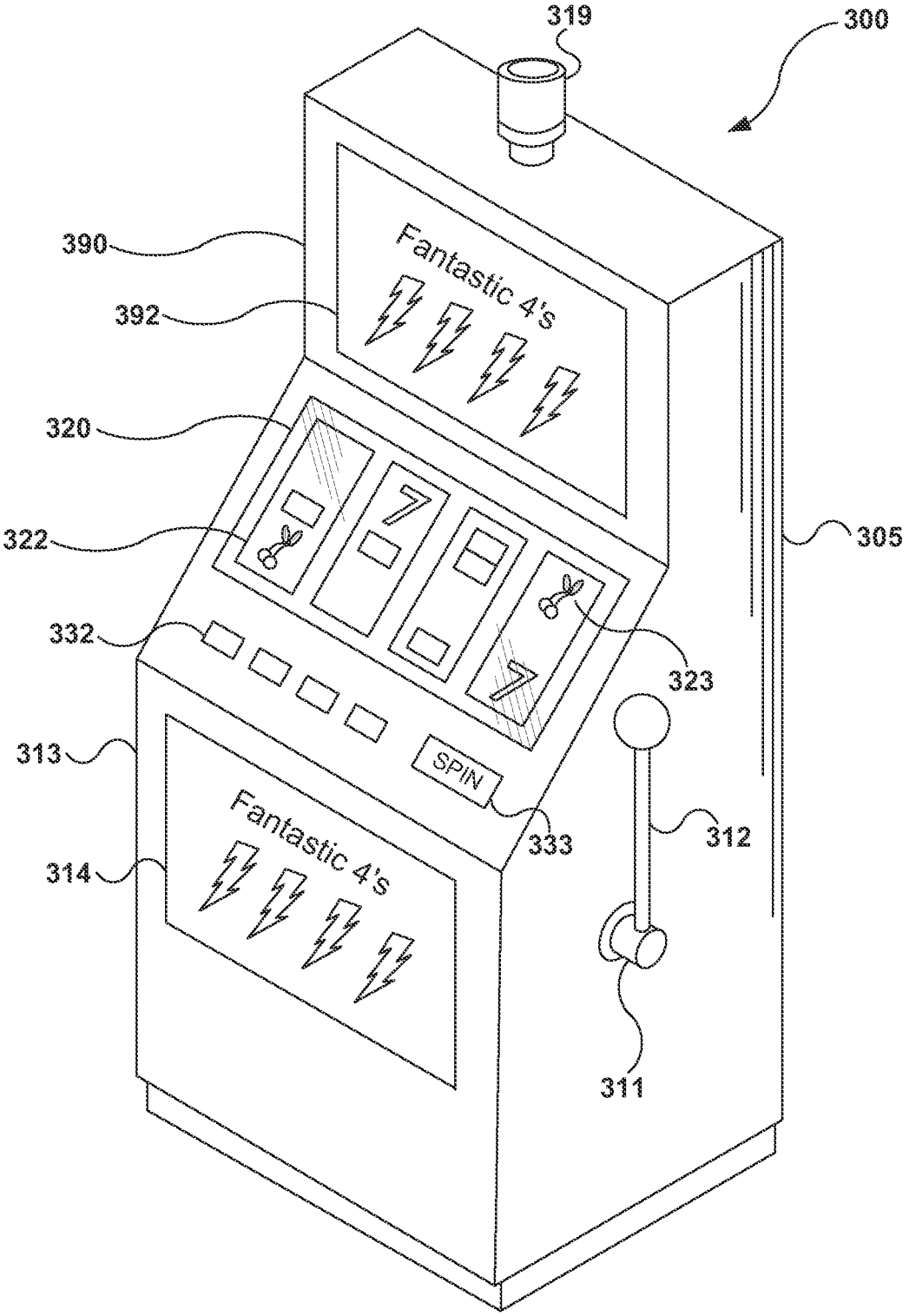
FIG. 3 is an isometric view of an example gaming device according to embodiments of the invention.

FIG. 3 is an isometric view of an example gaming device 300 according to embodiments of the invention.

Referring to FIG. 3, a gaming device 300 is a mechanical reel slot machine. The slot machine 300 includes a cabinet 305 housing components to operate the gaming device 300. The cabinet 305 may include a gaming display 320, a base portion 313, a top box 390, and a player interface panel with game buttons 332 and at least one game initiating button 333. The gaming display 320 includes four mechanical spinning reels 322 each showing multiple game symbols 323.

The base portion 13 may include a lighted panel 314, a coin return (not shown), and a gaming handle 312 operable on a partially rotating pivot joint 311. The game handle 312 is traditionally included on mechanical spinning-reel games, where the handle may be pulled toward a player to initiate the spinning of reels 322 after placement of a wager. The top box 390 may include a lighted panel, a video display (such as an LCD monitor) 392, a mechanical bonus device (not shown), and/or a candle light indicator 319.

The player interface panel may include one or more game buttons 332 that can be actuated by the player to cause the gaming device 300 to perform a specific action. For example, some of the game buttons 332 may cause the gaming device 300 to bet a credit to be wagered during the next game, change the number of lines being played on a multi-line game, cash out the credits remaining on the gaming device, or request assistance from casino personnel, such as by lighting the candle 319. In addition, the player interface panel may include one or more game actuating buttons 333. The game actuating buttons 333 may initiate a game with a pre-specified amount of credits. On some gaming devices 300 a "Max Bet" game actuating button 333 may be included that places the maximum credit wager on a game and initiates the game.

Figure 4:
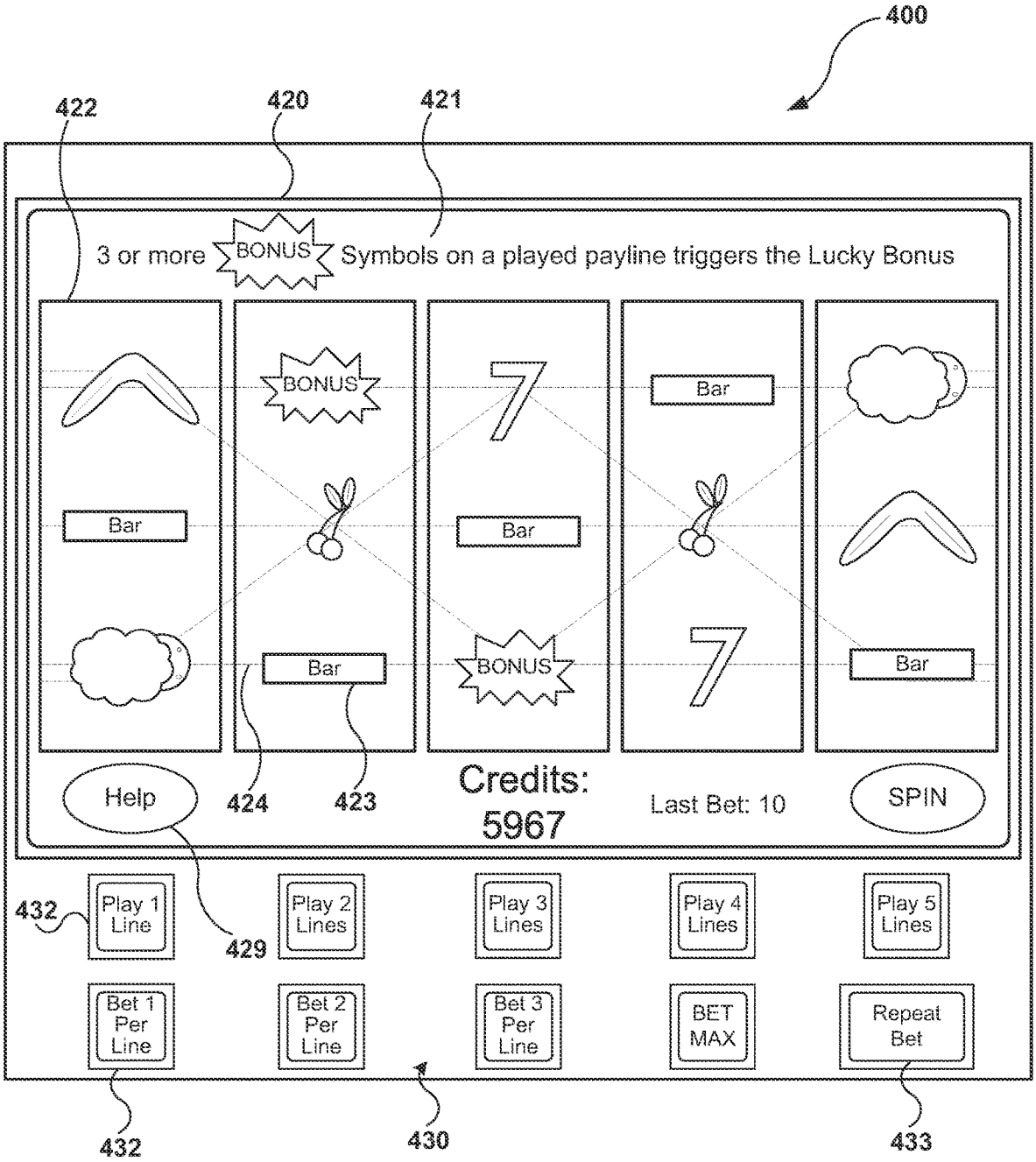
FIG. 4 is a detail diagram of another example gaming device according to embodiments of the invention.

FIG. 4 is a detail diagram of another example gaming device 400 according to embodiments of the invention.

Referring to FIG. 4, a video gaming machine 400 includes a video display 420 to display virtual spinning reels 422 and various other gaming information 421. The video display 420 may be a CRT, LCD, plasma screen, or the like. It is usually preferable that the video display 420 be a touch-screen to accept player input. A number of symbols 423 appear on each of the virtual spinning reels 422. Although FIG. 4 shows five virtual spinning reels 422, the flexibility of the video display 420 allows for various reel 422 and game configurations. For example, some video slot games 400 spin reels for each individual symbol position (or stop) that appears on the video display 420. That is, each symbol position on the screen is independent of every other position during the games. In these types of games, very large numbers of pay lines or multiple super scatter pays can be utilized since similar symbols could appear at every symbol position on the video display 420. On the other hand, other video slot games 400 more closely resemble the mechanical spinning reel games where symbols that are vertically adjacent to each other are part of the same continuous virtual spinning reel 422.

Because the virtual spinning reels 422, by virtue of being computer implemented, can have almost any number of stops on a reel strip, it is much easier to have a greater variety of displayed outcomes as compared to spinning-reel slot machines 300 (FIG. 3) that have a fixed number of physical stops on each spinning reel 422.

With the possible increases in reel 422 numbers and configurations over the mechanical gaming device 300, video gaming devices 400 often have multiple paylines 424 that may be played. By having more paylines 424 available to play, the player may be more likely to have a winning combination when the reels 422 stop and the game ends. However, since the player typically must wager at least a minimum number of credits to enable each payline 424 to be eligible for winning, the overall odds of winning are not much different, if at all, than if the player is wagering only on a single payline. For example, in a five line game, the player may bet one credit per payline 424 and be eligible for winning symbol combinations that appear on any of the five played paylines 424. This gives a total of five credits wagered and five possible winning paylines 424. If, on the other hand, the player only wagers one credit on one payline 424, but plays five games, the odds of winning would be identical as above: five credits wagered and five possible winning paylines 424.

Because the video display 420 can easily modify the image output by the video display 420, bonuses, such as second screen bonuses are relatively easy to award on the video slot game 400. That is, if a bonus is triggered during game play, the video display 420 may simply store the resulting screen shot in memory and display a bonus sequence on the video display 420. After the bonus sequence is completed, the video display 420 may then retrieve the previous screen shot and information from memory, and re-display that image.

Also, as mentioned above, the video display 420 may allow various other game information 421 to be displayed. For example, as shown in FIG. 4, banner information may be displayed above the spinning reels 422 to inform the player, perhaps, which symbol combination is needed to trigger a bonus. Also, instead of providing a separate credit meter, the same information can instead be displayed on the video display 420. In addition, "soft buttons" 429 such as a "spin" button or "help/see pays" button may be built using the touch screen video display 420. Such customization and ease of changing the image shown on the display 420 adds to the flexibility of the game 400.

Even with the improved flexibility afforded by the video display 420, several physical buttons 432 and 433 are usually provided on a player interface panel 430 of the video slot machines 400. These buttons may include game buttons 432 that allow a player to choose the number of paylines 424 he or she would like to play and the number of credits wagered on each payline 424. In addition, a max bet button (one of the game buttons 432) allows a player to place a maximum credit wager on the maximum number of available paylines 424 and initiate a game. A repeat bet or spin button 433 may also be used to initiate each game when the max bet button is not used.

Figure 5:
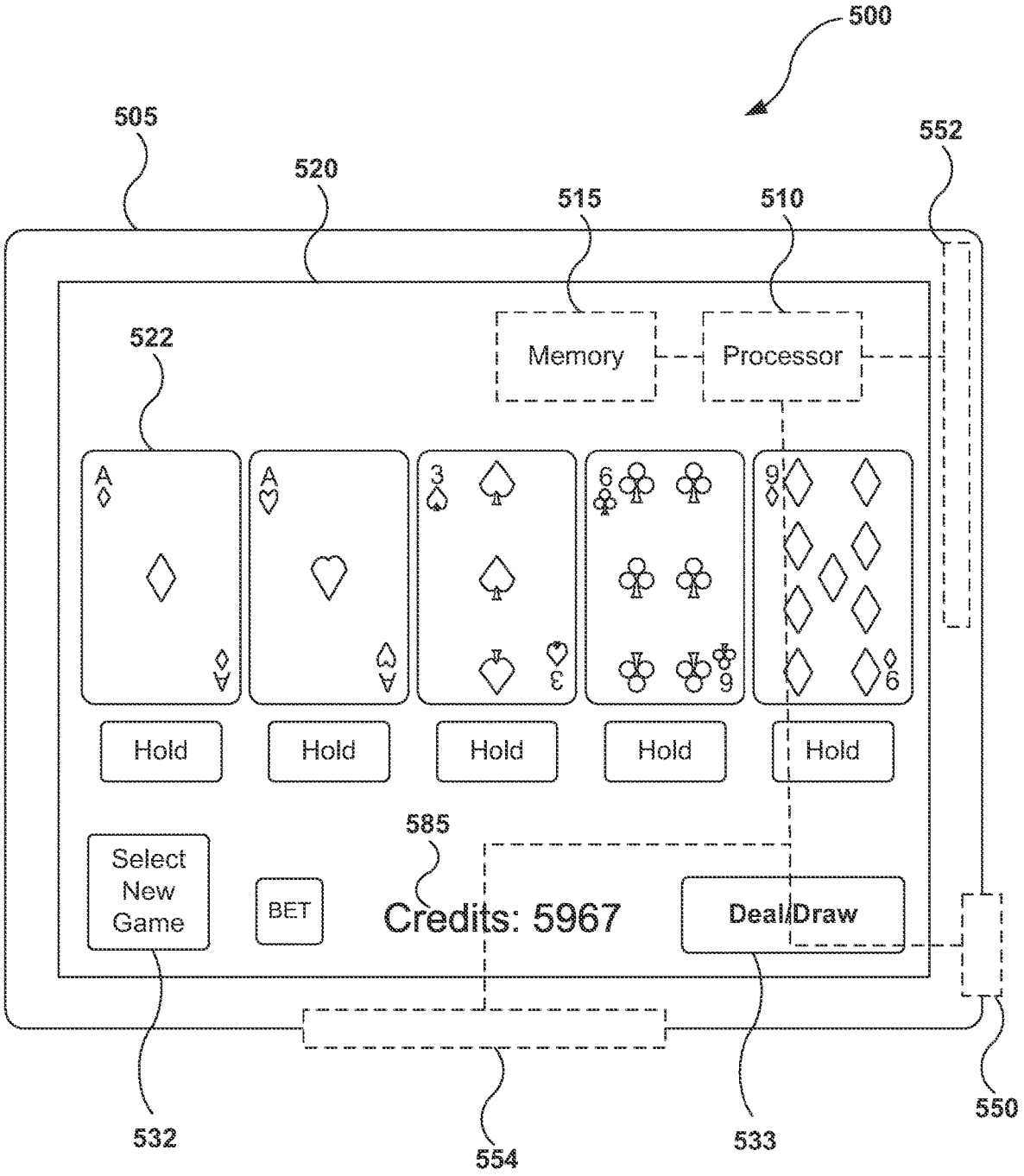
FIG. 5 is a detail diagram of a gaming device terminal that can be part of the gaming system illustrated in FIG. 1 according to embodiments of the invention.

FIG. 5 is a detail diagram of a gaming device terminal 500 in the gaming system illustrated in FIG. 1 according to embodiments of the invention.

Referring to FIG. 5, an example gaming device terminal 500 is implemented on a handheld wireless tablet, such as an IPAD or similar touchscreen modular device that can wirelessly connect to a gaming network. Here, the GDT 500 includes a game display 520 showing a plurality of game indicia 522 (cards used in a video poker game), one or more game buttons 533 related to game play of a selected game, a credit meter 585 associated with a player credit account, and a game library button 532 that takes a player to a game library screen. In addition, the GDT 500 includes a local processor 510, a memory 515 connected to the processer, a wireless antenna 552, a communication port 550, and a docking port 554.

The memory 515 is connected to the local processor 510 and may be configured to store various game information about game play, such as downloaded game graphics or sounds or player identification information used to access a player loyalty account or player credit account. This memory may be volatile (e.g., RAM), non-volatile (e.g., flash memory), or include both types of memory. The wireless antenna 552 may be connected to the processor 510 and be used to communicate with a wireless transceiver or antenna 120 (FIG. 1) coupled to a gaming network 150. The wireless antenna may be configured to receive any of a number of types of wireless communication signals, or may be configured to only receive a casino specific (or encrypted) signal.

The communication port 550 is also connected to the local processor 510. In some embodiments, this communication port 550 may be a universal serial bus (USB) port that allows a player to upload player information or preferences, or download game session statistics or other information. The USB port may be used to connect the GDT 500 to a personal computer or to a player thumb flash drive. In other embodiments, the connection port 550 may be structured as a serial port, parallel port, Ethernet port, optical connection, a second wireless antenna, or any other type of communication port used to transmit and receive data. Although only one connection port 550 is shown in FIG. 5, the gaming device terminal 500 may include multiple communication ports. As described below, in many existing gaming devices, this connection port 550 is a serial connection port utilizing a SAS protocol to communicate to one or more remote game servers, such as player tracking servers, bonus servers, accounting servers, etc.

The docking port 554 may be used to connect the GDT 500 to a stationary game or docking station (135 FIG. 1) for enhanced game play. For example, as mentioned above, a docking station 135 may include a larger game display, a ticket/bill acceptor, a ticket printer, a comfortable chair, physical game buttons, faster connection speeds, or other features that make the gaming experience easier and/or more enjoyable. The docking station 135 may also allow a battery in the GDT 500 to recharge. The docking port 554 or the communication port 550 may be used with a card swipe attachment, biometric reader, or other device capable of identifying a player to access a player loyalty account and/or a player credit account. Alternatively, other embodiments of a GDT 500 may not include one or both of the communication port 550 and docking port 554.

Figure 6:
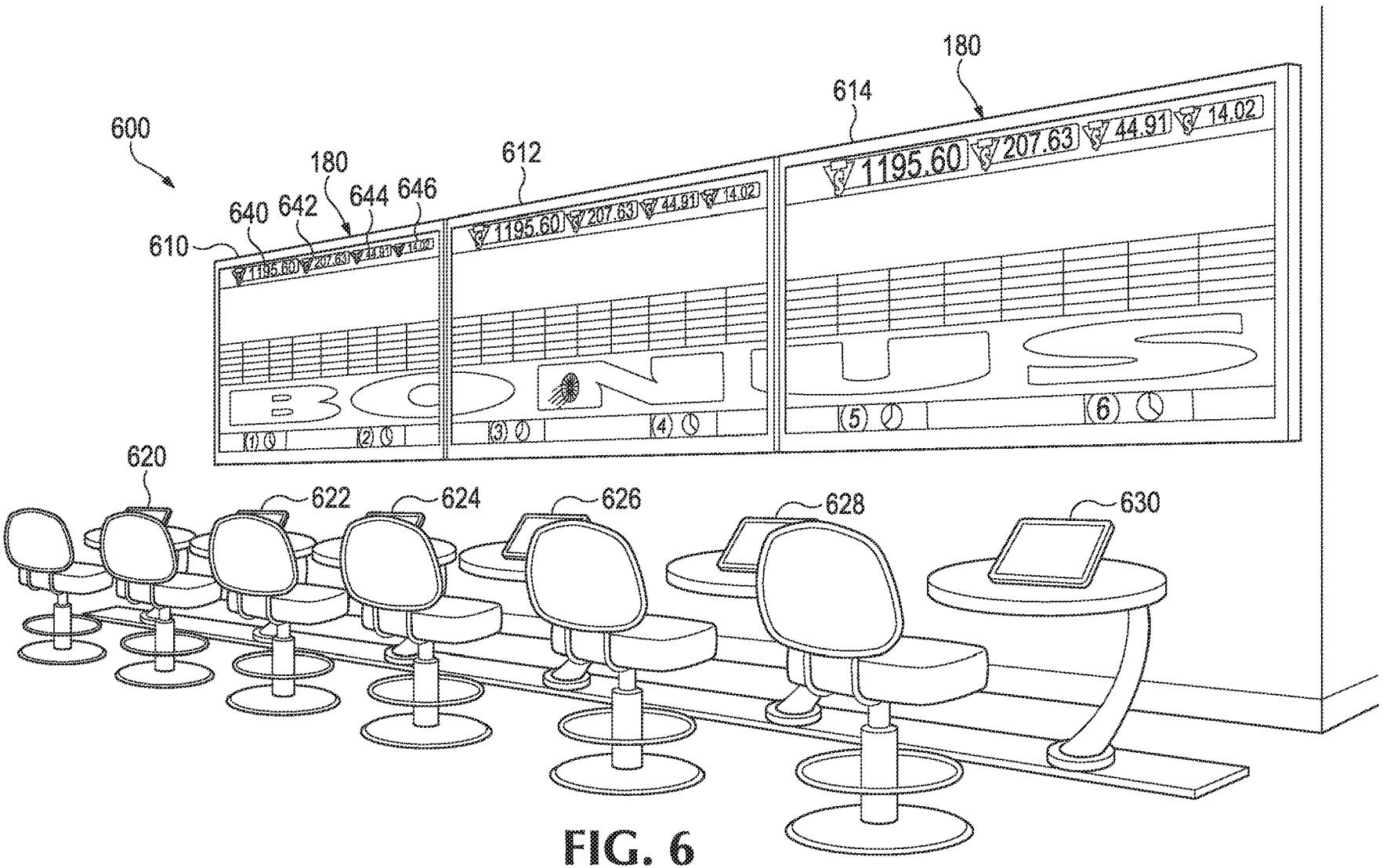
FIG. 6 is a perspective view of linked gaming devices according to embodiments of the invention.

Turning now to FIG. 6, indicated generally at 600 is a bank of gaming machines that corresponds to a bank of gaming machines 110 in FIG. 1. In the embodiment in FIG. 1, bonus controller 120 includes computer code—described in more detail hereinafter—that controls bank 600. Bonus controller 120 also controls, at least in part, video display 180 (in FIG. 1), which is associated with bank 600. Although the present embodiment is depicted as being part of gaming system 100, embodiments of the invention can be implemented in which bank 600 is a dedicated, stand-alone system, i.e., not networked with other gaming machines.

Bank 600 is shown with its associated video display 180. In the present embodiment of the invention, display 180 comprises a single display made up of three 55-inch, LCD video screens 610, 612, 614. Bank 600 includes 6 games, each implemented on a portable computing device 620, 622, 624, 262, 628, 630. Here each device comprises an iPad™ device manufactured by Apple Inc., although other devices could be used, including traditional upright gambling machines. The number of devices is variable, typically ranging from 4 to 8, but the invention may be implemented with any number. Similarly, the number of video screens, like screens 610, 612, 614, that make up video display 180 is also variable. In fact, the video display may be implemented in any manner, on single or multiple screens, and in any size. Alternatively, each gaming device 620-630 may have a separate screen associated with it upon which the video display appears.

Each of devices 620-630 is programmed to operate as an electronic gaming device. Each is on a network, as described in FIG. 1, along with video display 180. The devices 620-630 and video display 180 each communicate with bonus controller 120, the video display via network 150. But in some embodiments the video display could be connected directly to bonus controller 120. Each device 620-630 may play the same game or different games. In any event, each game played on one of the devices has its own rules and pay table and pays a player in accordance with its rules and pay table. In the illustrated version, a percentage of each credit wagered at each of the games in bank 600 is allocated to each of four different pools, which each accrue money that is awarded in a bonus game. This will be shortly described in more detail. The present implementation includes four pools that accrue simultaneously. The pools range from the smallest, which is frequently awarded, to the largest, which is less frequently awarded. The pools can be any number or size.

An additional pool also accrues a percent of each wager made on bank 600. Fixed amounts, as opposed to accrued pool values, are awarded from this additional pool as will soon be seen. The value of each of the four accruing pools is shown on each of the screens in display 180. By way of example, video meters 640, 642, 644, 646 at the top of screen 610 show the current amount of each pool. Meter 640 reflects the value of the largest pool, which is displayed in larger numerals than the other three pools. As can be seen, each of the other two screens incorporate duplicate video meters so that all players on bank 600 can readily see the current amount in each pool.

Figure 7:
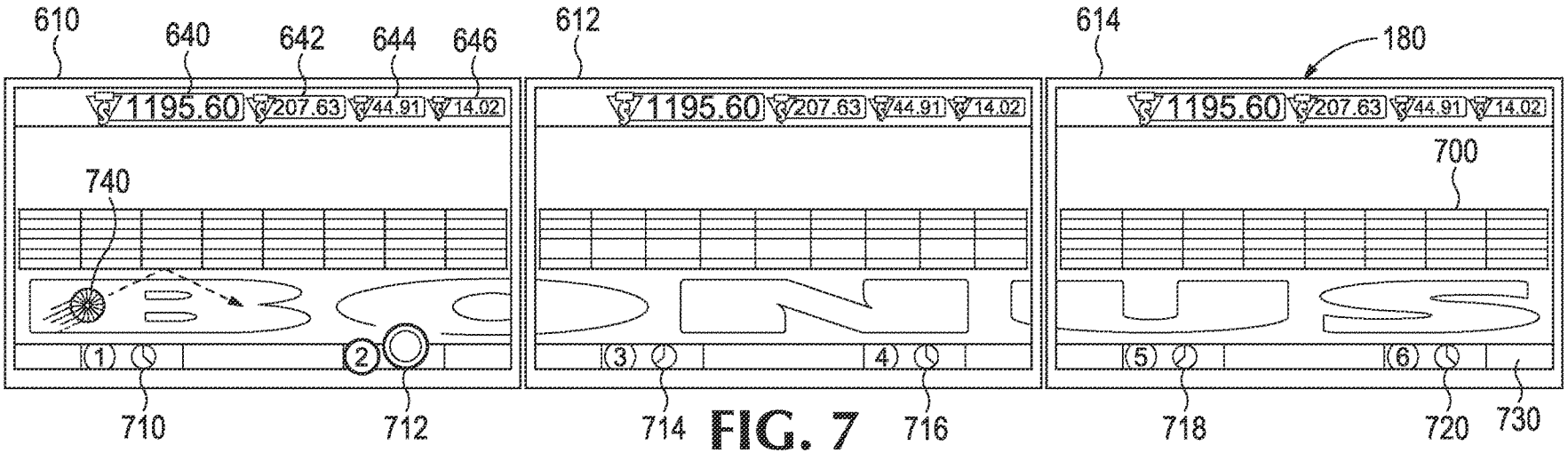
FIGS. 7-20 are front elevational views of the video screens in FIG. 4 showing sequential phases of a bonus game according to embodiments of the invention.

Before describing the manner in which bonus controller 120 operates, consideration will first be given to the experience of a typical player. Put differently, the following description, which is tied to sequential images on display 180, illustrates the manner in which a bonus game is played. Turning attention now to FIG. 7, an image of a brick wall 700 extends across all of display 180. Each gaming device in bank 600 includes an associated icon 710, 712, 714, 716, 718, 720, which appears on display 180 within a lower bar 730 in front of its corresponding gaming device. Like brick wall 700, lower bar 730 also extends across all of display 180. As can be seen, a number 1-6 is adjacent each icon. Each icon is therefore associated with a player of the gaming device for so long as he or she is at the gaming device. As used herein, player 1, player 2, . . . player 6 refers to the player playing the corresponding gaming device 620-630. It should be appreciated that the bonus game may be enabled even though not all of the gaming devices in bank 600 are being played.

Finally, FIG. 7 includes a bouncing wheel 740, which bounces back and forth between the upper surface of bar 130 and the lower surface of brick wall 700. As can be seen by sequentially viewing the position of wheel 740 in FIGS. 7-15, the wheel bounces back and forth while moving first to the right and then to the left. Player 2, the player at gaming device 622, is selected to participate in a bonus round. As will be seen in more detail, the selection may result from actions accrued by the player, e.g., credits wagered, specific awards won, etc., with some of the actions possibly being accrued on different gaming machines. Alternatively, selection may result from actions accrued at gaming device 622, with some of the actions possibly being accrued by different players. Further still, selection may be influenced by player status, loyalty card use, wager size, or the player's birthday. Any one of the foregoing or any combination thereof may be used to trigger a bonus game for a selected player or gaming device.

Figure 8:
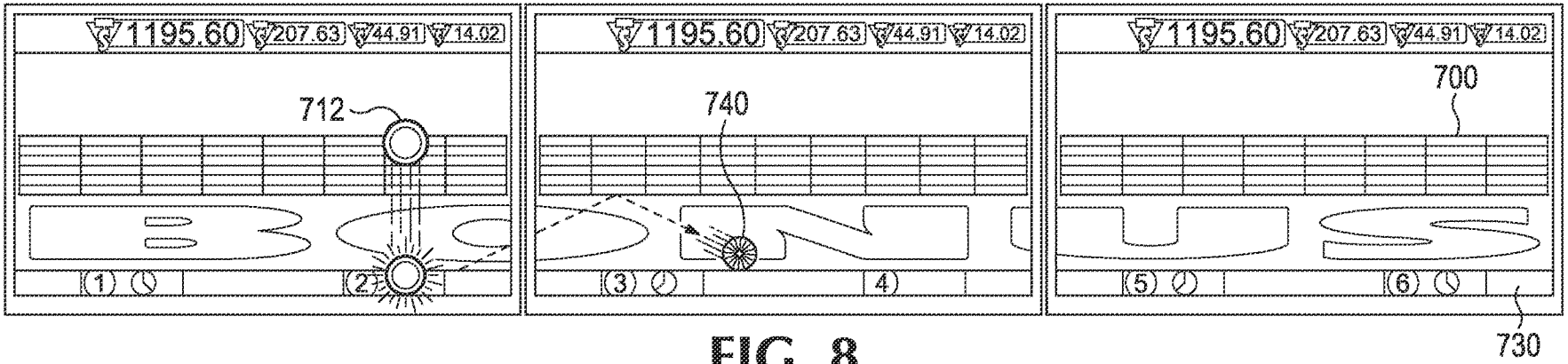
Figure 9:
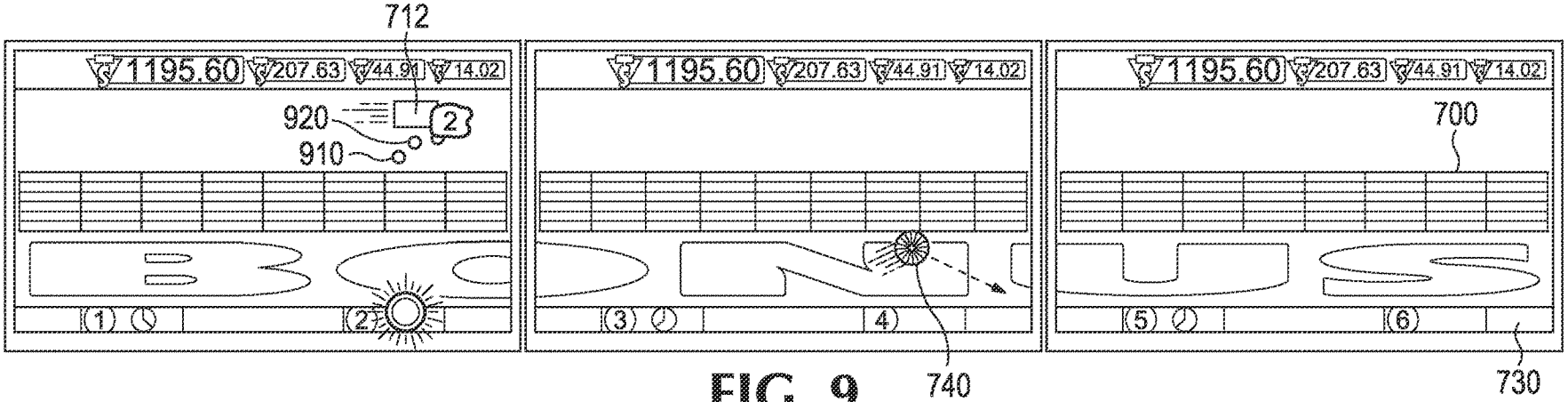

Regardless of how selected, player 2 is notified of his or her selection by icon 712, which begins to glow and grow slightly in size. Accompanying sounds effects alert all of the players to the fact that a bonus game is initiated. Players may continue to play the games on the gaming devices in bank 600 while keeping an eye on the unfolding bonus game on display 180. As can be seen in FIG. 8, icon 712 rises from its position (shown glowing) within lower bar 730 above brick wall 700, changes slightly in shape, and begins lateral movement to the right, as shown in FIG. 9. A duplicate of icon 712 remains in lower bar 730 in front of the player of device 622. Also in FIG. 9, the icon begins dropping animated coins, like coins 910, 920, which strike bricks in wall 700. The number of coins dropped may be related to the accrued qualifying action. For example, if wagering 50 credits on bank 600 qualifies a player for a bonus round, the icon can drop a corresponding number of coins or some fraction or multiple thereof.

Figure 10:
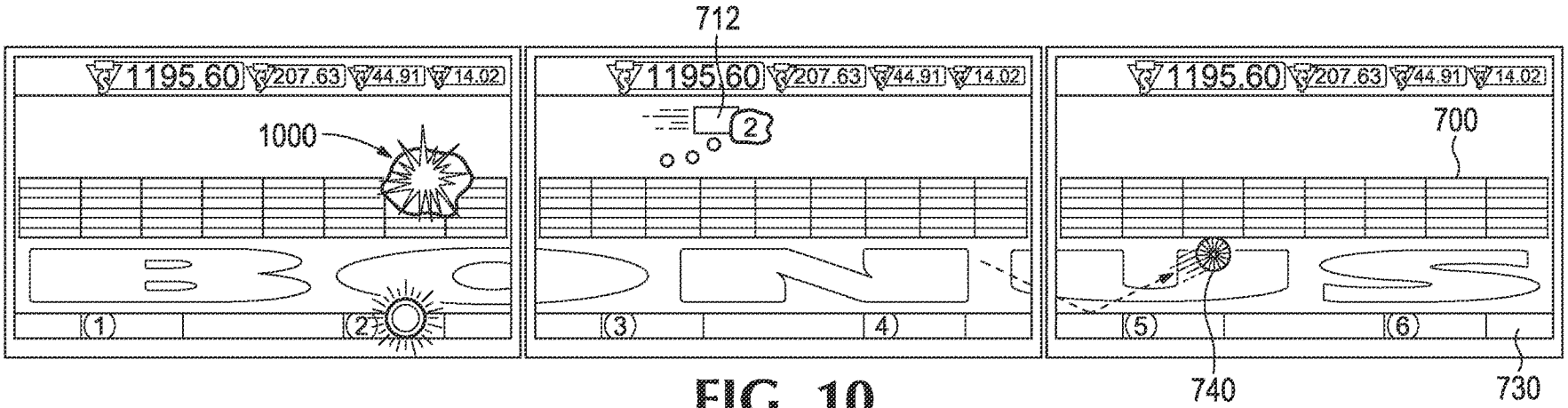
Figure 11:
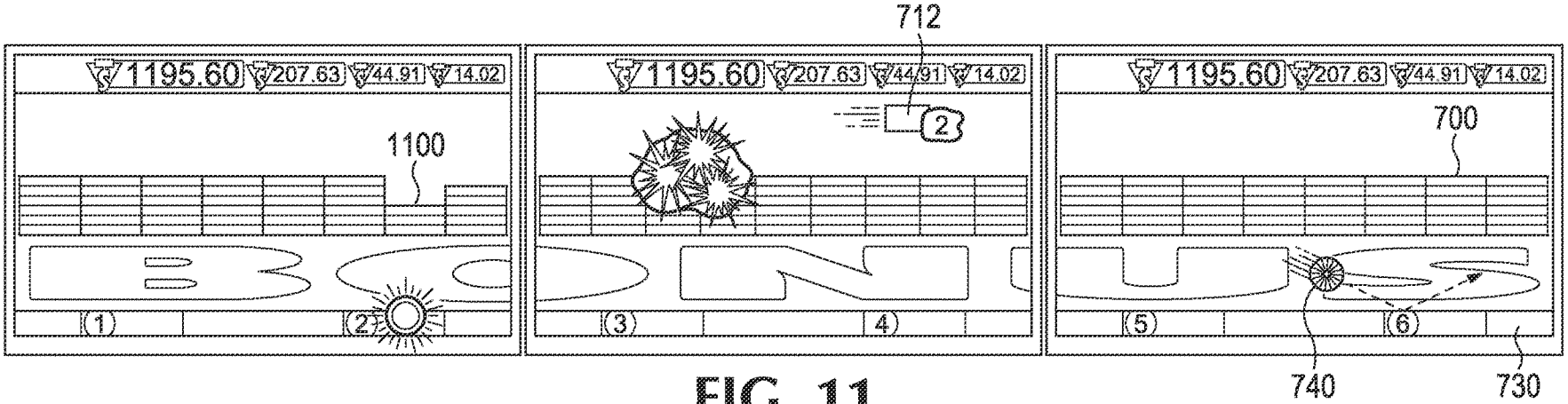

As seen in FIG. 10, each coin that hits wall 700 explodes at least one brick thereby weakening the wall. Such an explosion 1000 is depicted in FIG. 10. As shown in FIG. 11, a gap 1100 appears in wall 700 at the location of explosion 1000. Further explosions resulting from dropping coins are depicted in FIG. 11. Wheel 740 continues to bounce back and forth between the underside of wall 700 and the upper surface of bar 730.

Figure 12:
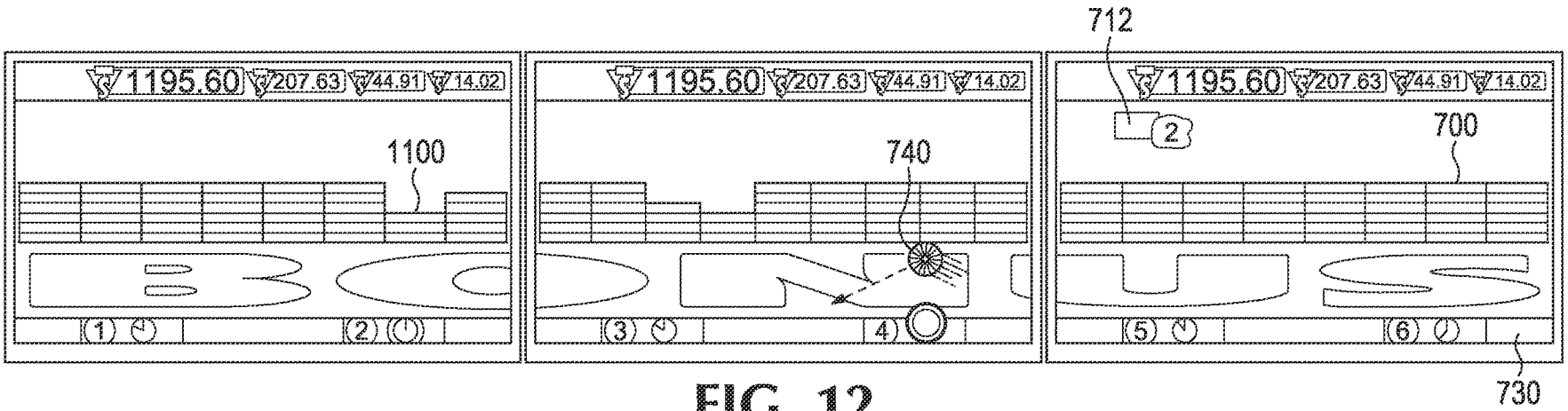

In FIG. 12, all coins that are associated with player 2 have been used. As a result, the bonus round ends with wall 700 partially broken away as shown and with wheel 740 continuing to bounce back and forth.

Play on the games in bank 600 continues until another bonus round is triggered by one of the methods mentioned above. The amount of time between bonus rounds can be configured along with the amount and frequency of the bonus awards using known statistical methods.

Figure 13:
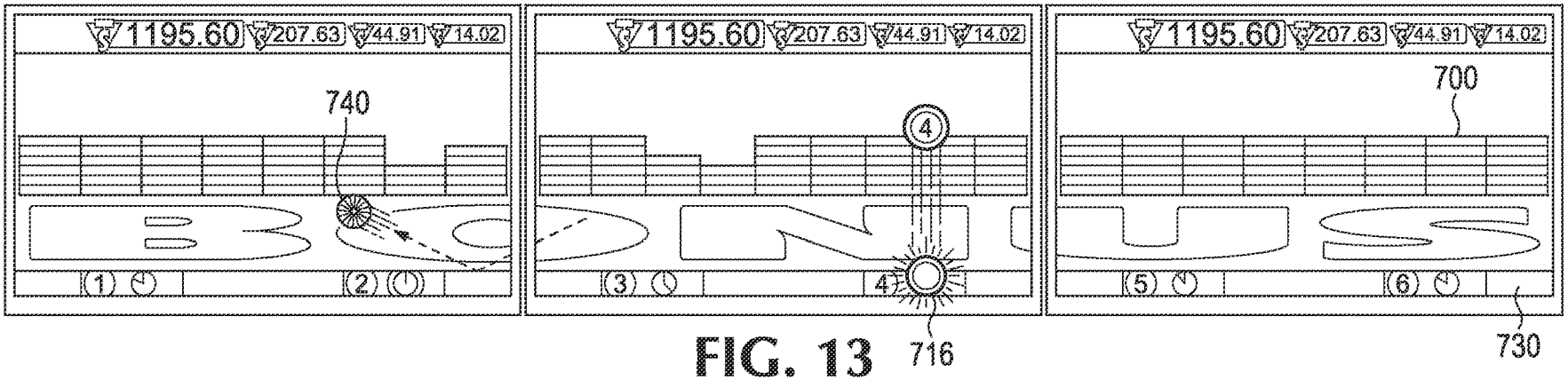
Figure 14:
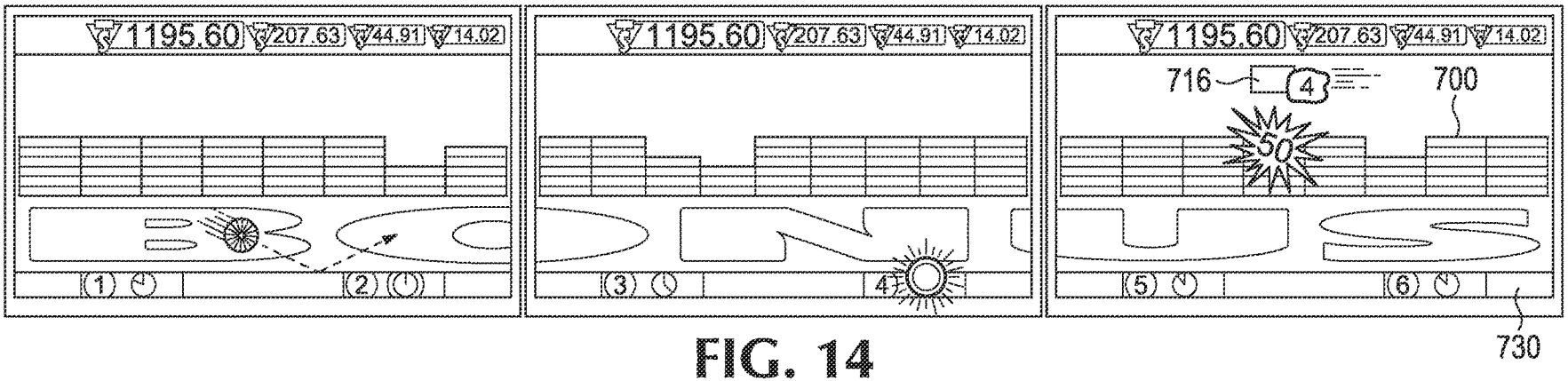

In FIG. 13, a further bonus round is triggered. This bonus round is associated with player 4. As a result, icon 716 rises above brick wall 700 as can be seen. In FIG. 14 icon 716 drops coins to explode bricks as before. Most bricks simply explode, but as can be seen in FIG. 14, some bricks have an associated fixed bonus amount, in this case 50 credits. As a result, 50 credits are awarded to player 4 when this brick explodes. As will be seen, this feature induces players to play the gaming devices in bank 600 even though very few, if any, bricks have been exploded by previous players.

Figure 15:
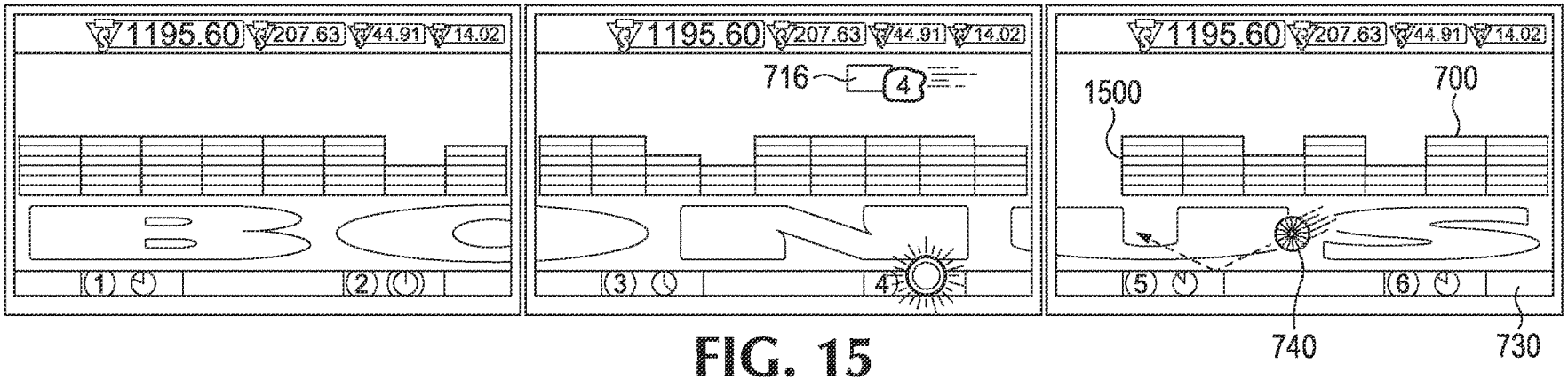
Figure 16:
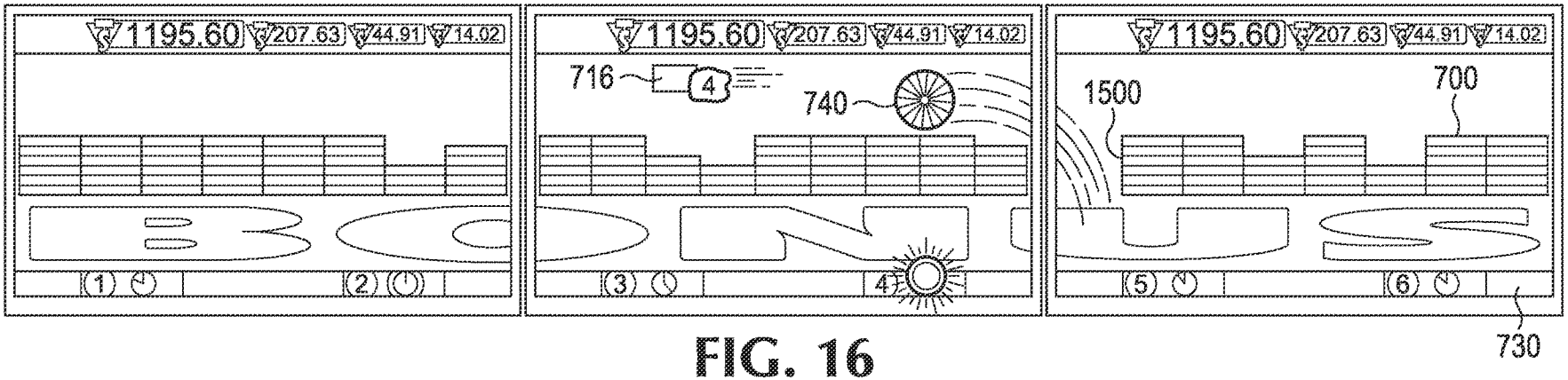
Figure 17:
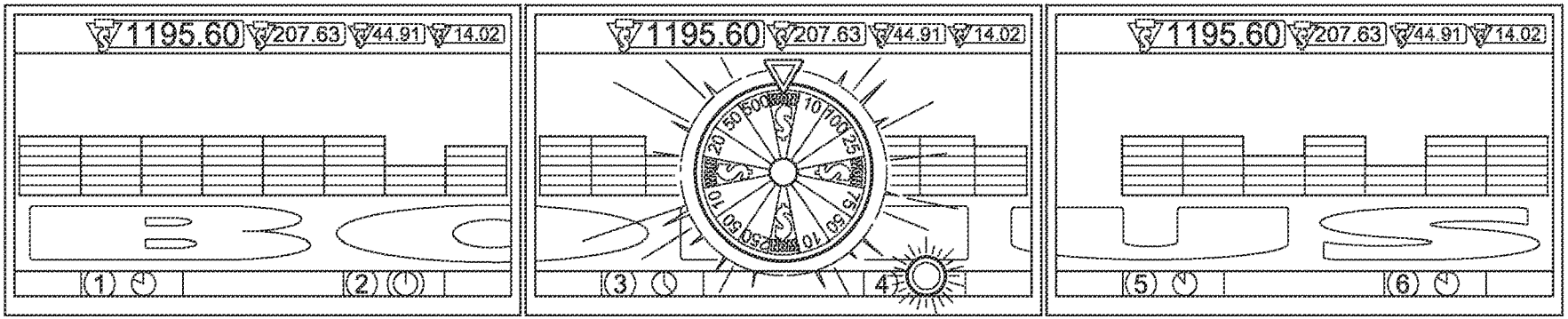
Figure 18:
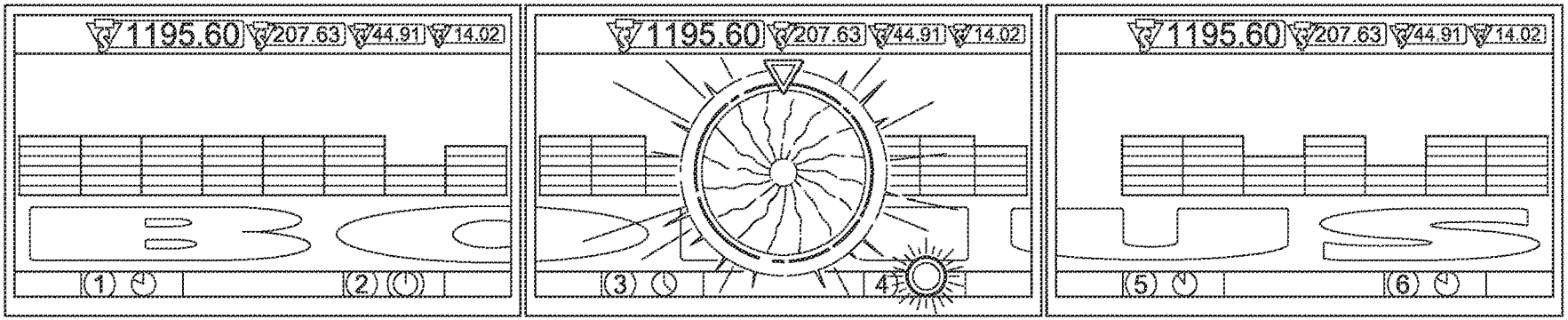

FIG. 15 illustrates wall 700 after further play explodes all bricks in a section of the wall thus creating an opening 1500 through the wall. Wheel 740 continues to bounce back and forth after creation of opening 1500. Eventually the wheel passes through the opening to the upper side of the wall as shown in FIG. 16 when it's bouncing trajectory aligns with opening 1500. Once on the upper side of wall 700, in FIG. 17, the wheel grows in size and displays award segments as shown. Then the wheel spins as shown in FIG. 18. It should be noted that the wheel can begin to spin on its own, i.e., automatically, or spinning can start as a result of action by player 4 at gaming device 626.

Figure 19:
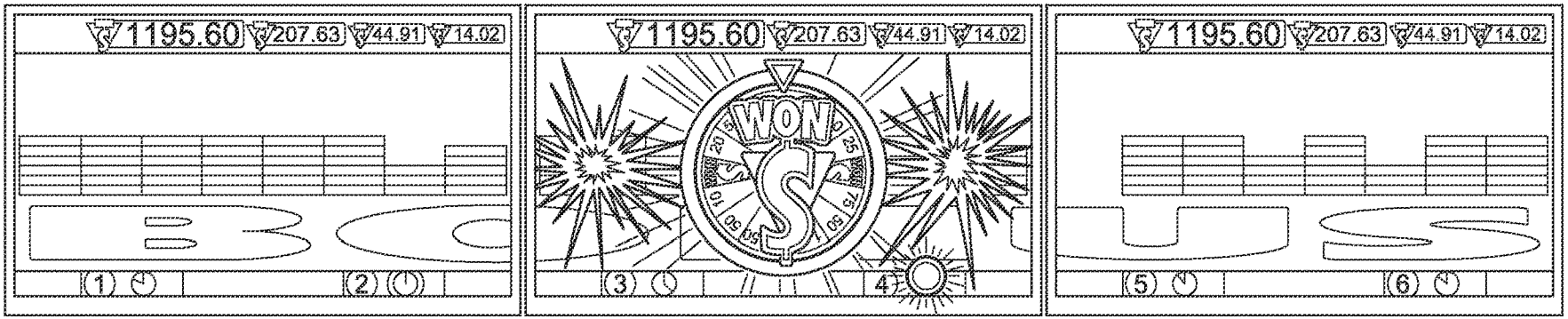
Figure 20:
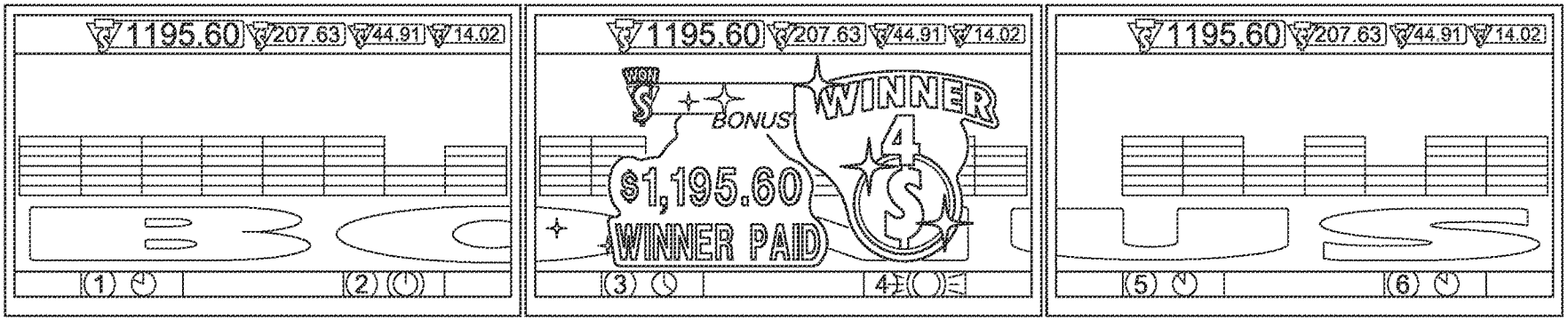

When the wheel stops spinning, either a fixed amount or one of the four pools is awarded to player 4. In FIG. 19, the player won the top award, with appropriate celebratory sounds and accompanying video as shown in FIGS. 19 and 20.

Figure 21:
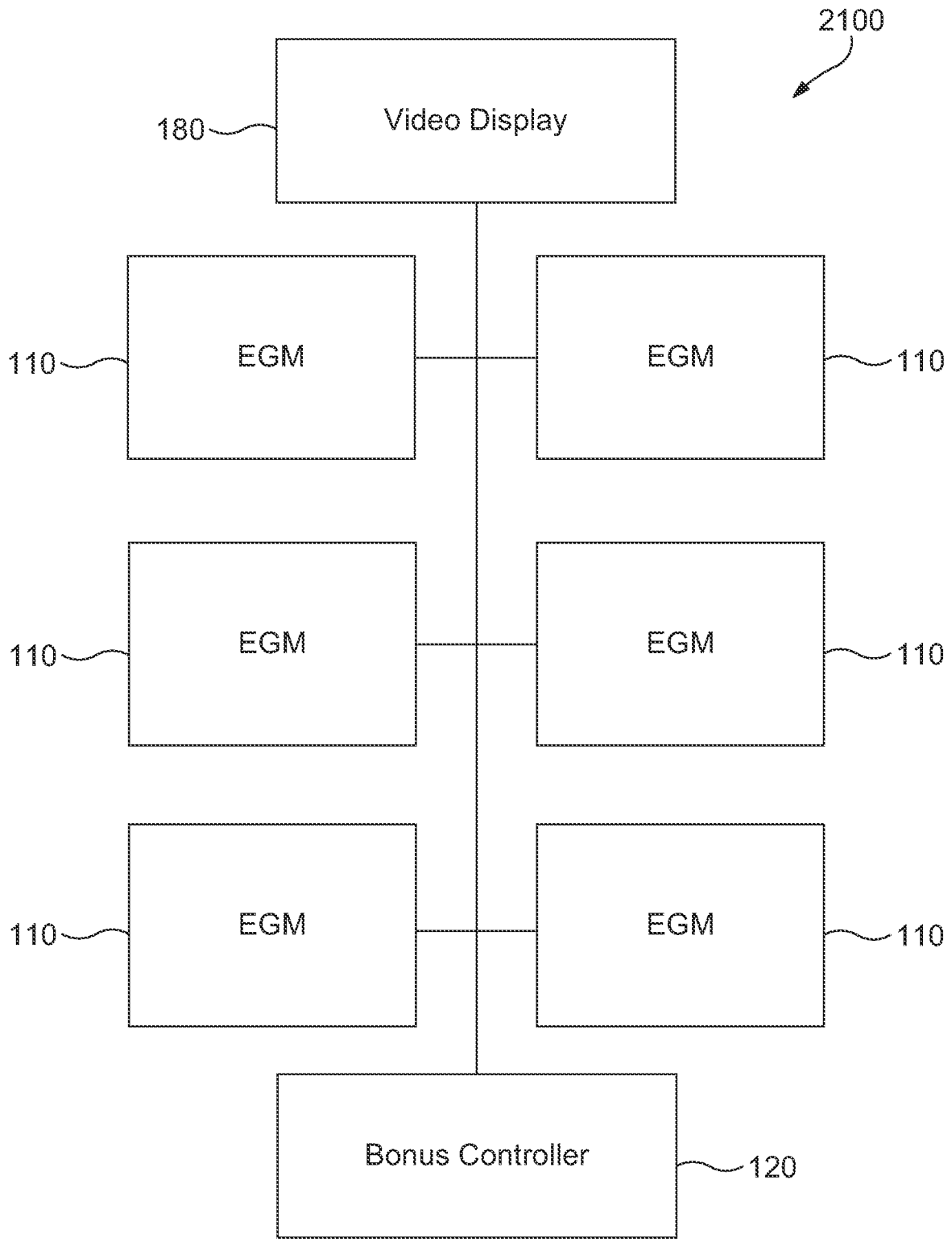
FIG. 21 is a functional block diagram of networked gaming devices according to additional embodiments of the invention.

Turning now to FIG. 21, indicated generally at 2100 is a system that incorporates another embodiment of the invention. Structure that corresponds to that previously identified retains the same numeral in FIG. 21. Bonus controller 120 serves a similar function to bonus controller 120 in FIG. 1. System 2100, however, may be a dedicated, stand-alone system that is not incorporated into a larger network. Alternatively, system 2100 may communicate with a player-tracking server to track player actions that may qualify a player for a bonus round on system 2100. As with other embodiments, gaming machines 110 may take different forms, such as devices 620-630 in FIG. 6.

Figure 22:
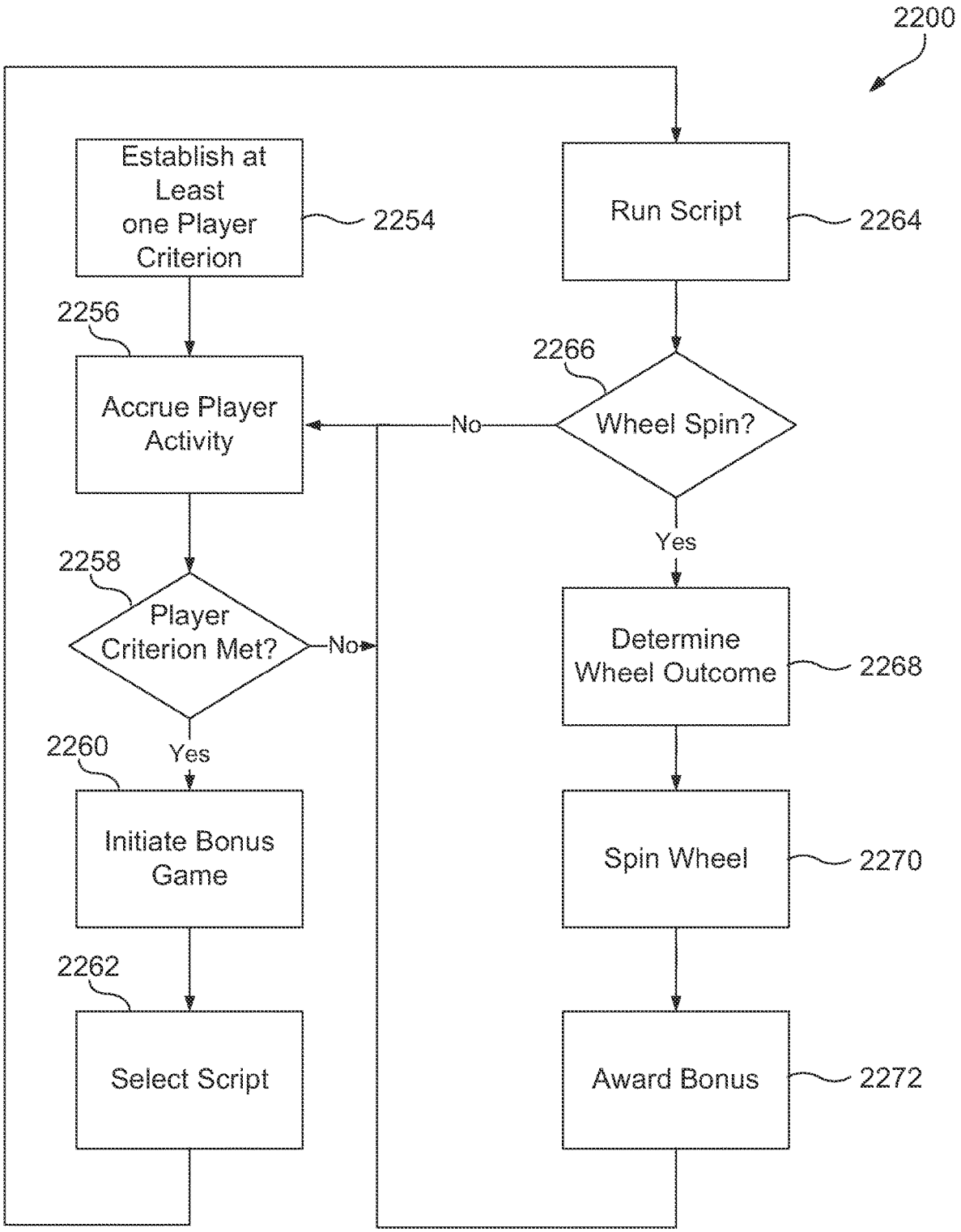
FIG. 22 is a flow chart depicting operation of linked gaming devices according to embodiments of the invention.

A flowchart, indicated generally at 2200 in FIG. 22, describes a process that may be used to implement the present invention. The process illustrated in FIG. 22 may be implemented in the system of FIG. 1, typically at least in part on bonus controller 120; the system of FIG. 21; or in any other suitable system. As is known in the art, it may be distributed among a plurality of computing devices.

At box 2254 at least one player criterion is established. This criterion may be selected from the data that is tracked by the player tracking system described above. For example, the criterion may comprise one or more of credits wagered, awards paid, gaming-device wins or win magnitude, rate of game play, player historical wagering parameters, etc. It may comprise any data that can be derived from data tracked by the player tracking system.

In box 2256, while the players play the gaming devices in bank 600, the tracked data for each player is accrued by the player tracking system, which is communicated to process 2200. It should be noted that play beyond bank 600 may be included as part of the criterion and accordingly tracked. In diamond 2258, the process checks to see whether the criterion is met. If no, the process returns to box 2256. But if yes, the process goes to box 2260 where the bonus is initiated.

The game may be initiated in a variety of ways. In one way, there is a threshold qualifying action, e.g., 50 credits wagered. Because of the player tracking system, those credits can be on any of the gaming devices in bank 600 or even on gaming devices beyond bank 600, like those shown in FIG. 1. The bonus game initiates once the 50 credits are wagered.

Another way to initiate the bonus game is a mystery jackpot counter associated with each player. When each player starts to play one of the gaming devices in bank 600 a random number between high and low limits is selected, and the qualifying actions are counted starting at the low limit. Again, if the qualifying action is credits wagered, each player enters the bonus round when he or she wagers credits sufficient to count to the randomly selected number.

Still another way to initiate the bonus game is to create a weighted pay table that is checked each time a qualifying action, e.g., credit wagered, occurs to see if the bonus game is triggered.

Yet another way is to check for specific game outcomes, e.g., a particular symbol appearing on the third reel of a slot machine.

Regardless of how the bonus game is initiated, once a player is selected to play, the process initiates another mechanism that determines the progress or outcome of the bonus game, e.g., by selecting one of a plurality of scripts. The script may be one that allows the player to break a number of bricks that is equal to the number of qualifying actions for the bonus game, e.g., play 50 credits; break 50 bricks. Alternatively, where the qualifying mechanism is a mystery jackpot, the script may be one that permits a number of bricks that corresponds to the time the player took to qualify. Still another approach is to permit the determination, i.e., which script to run, be made by a weighted pay table that is consulted after a player qualifies for the bonus game. In any event, after a bonus game is initiated in box 2260, a script is selected in box 2262, e.g., by one of the foregoing techniques.

In box 2264, the selected script runs. A script determines the outcome for each player of the bonus game. For example, a first script created the displays depicted in FIGS. 8-11, which is associated with play by player 2 and a second script depicted the displays in FIGS. 12-20, which is associated with play by player 4. It should be noted that the first script, run for player 2 in FIGS. 8-11, did not result in an opportunity to spin wheel 740. As a result, in diamond 2266, upon completion of the first script, the process branches back to box 2256 where player activity continues accruing. The second script created a 50-credit exploding brick in FIG. 16, which also included the chance to spin the wheel. But other scripts, not illustrated, include exploding bricks associated with credits that do not result in a wheel spin. In other words, any player of the bonus game has the opportunity to receive credits associated with exploding bricks whether or not that script includes an opportunity to spin wheel 740.

The second script, run for player 4 in FIGS. 12-20, did result in an opportunity to spin the wheel. As a result, at diamond 2266, the process branches to box 2268 where a wheel outcome is determined. The outcome may be determined by any appropriate method, including, e.g., a weighted pay table. A wheel spin is then presented to the player at box 2270, and any credits awarded, which may be one of the accruing pools or a fixed number of credits, at box 2272. The award may be made in any manner that gaming awards can be made, such as by applying credits to a credit meter on gaming device 110, by hand pay, by deposit to account, or by any other method. The process then returns to continuing to accrue player activity at box 2256.

Figure 23:
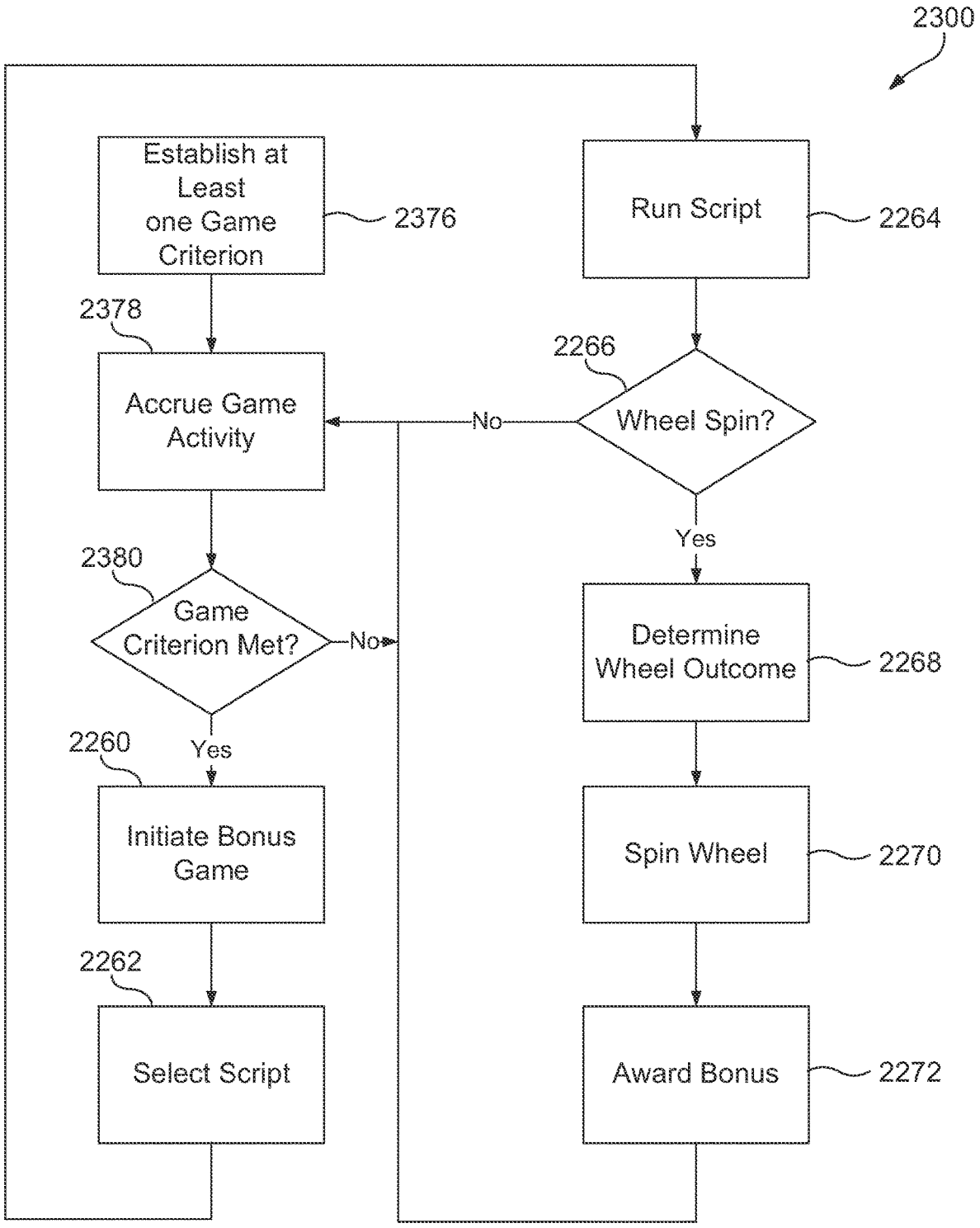
FIG. 23 is another flow chart depicting operation of linked gaming devices according to embodiments of the invention.

A second process 2300 in FIG. 23 controls the bonus game in a slightly different fashion. Boxes and diamonds that have the same functionality as those in FIG. 22 retain the same numeral in FIG. 23. In process 2300, rather than establishing and tracking player activity, the process establishes and tracks activity on at least one (and typically, but not necessarily, on all) of the gaming devices in bank 600, even if different players created the tracked game device activity. Process 2300 could be used to implement the invention in an embodiment that did not include player tracking.

Known techniques for attributing credit to an untracked player may be used to analyze play on a gaming device and associate it with an anonymous player at one of the gaming machines. This permits players that are not using the tracking system, or at least are not currently identified to it, to acquire some or all of the benefits described herein. Of course the processes described herein could be limited to a single gaming machine even if it used by a player who is known to the system, i.e., tracked. In this way, uncarded or unidentified players can participate or participation—or some higher level of participation—could be limited to identified players. In short, an identified player may participate across a number of linked games or a player's participation may be limited to activity on a single gaming machine, whether or not the player is identified.

Many of the same qualifying actions that are monitored by player in FIG. 22 could be used to set the game criterion in box 2376, e.g., coin in. In FIG. 23 process 2300, or alternatively another process implemented on the network associated with bank 600, monitors the actions of each gaming device 620-630 in box 2378. When diamond 2380 determines that one of the gaming devices in the bank meets the criterion, a bonus game is initiated for the player of the gaming device that met the criterion. From box 2260 play continues as described in connection with the process of FIG. 22.

In addition to qualifying actions on the part of players, as depicted in FIG. 22 and qualifying actions by gaming device, as depicted in FIG. 23, qualifying may occur or be further affected on a player by player basis. For example, bonus coins for exploding the bricks may be given to selected players based on loyalty card use, status, wager size, birthday, etc.

In one such case, the qualifying player criterion is wagering 50 credits, which provides for 50 coins with which to explode bricks in the bonus game. If the player is using a player-tracking card, he or she may be entitled to 20 extra coins. And if it is the player's birthday still another 50 coins may be awarded.

Any combinations of qualifying, including player activity, game activity, and player identity, may be used to qualify a player to play the bonus game.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming system for implementing a bonus game having sequential phases that follow one another and progress from an initial phase that starts an instance of the bonus game to a concluding phase in which a winner is designated, the gaming system comprising:

a plurality of linked electronic gaming machines, each of which includes:

a housing;

at least one display device supported by the housing; and a plurality of input devices supported by the housing, each input device including:

an acceptor of a physical item associated with a monetary value, a validator configured to identify the physical item, and a cashout device configured to receive an input to cause an initiation of payout associated with a credit balance;

at least one processor;

a video screen that is viewable by players of the linked electronic gaming machines; and at least one non-transitory memory device that stores a plurality of instructions which, when executed by the at least one processor, cause the at least one processor to:

track gaming activity of a plurality of the gaming machines during multiple plays of at least two of the gaming machines;

establish at least one criterion related to the tracked gaming activity;

accumulate tracked gaming activity during the multiple plays;

display the bonus game on the video screen;

associate an initial phase of an instance of the bonus game with a first player of one of the gaming machines;

enable the initial phase at a first time when the accumulated tracked gaming activity meets the at least one criterion;

permit only the first player to play the initial phase;

run the initial phase of the instance of the bonus game according to a first script;

end the initial phase of the bonus game and suspend play of the bonus game;

continue to track gaming activity while play of the bonus game is suspended;

associate a second phase of the instance of the bonus game with a second player of one of the gaming machines, the second player being different from the first player;

enable the second phase at a second time after the first time when the accumulated tracked activity meets the at least one criterion;

permit only the second player to play the second phase;

run the second phase of the instance of the bonus game according to a second script;

periodically enable additional phases of the instance of the bonus game for play of each additional phase by one player at a time, the display depicting further advances of the bonus game in each phase toward a game-concluding goal;

run each phase according to a script until a game-concluding script running one of the phases results in an award;

give the award to the player playing the phase of the instance of the bonus game that is run by the game-concluding script; and end play of the instance of the bonus game when the phase run by the game-concluding script is concluded.

2. The gaming system of claim 1 wherein gaming activity comprises operating parameters of a plurality of the gaming machines.

3. The gaming system of claim 1 wherein gaming activity comprises player gaming history of a plurality of the players of the gaming machines.

4. The gaming system of claim 1 wherein the award comprises an opportunity to play a game.

5. The gaming system of claim 1 wherein the gaming activity further comprises gaming activity on gaming machines beyond those in the linked gaming machines.

6. The gaming system of claim 1 wherein the plurality of instructions, when executed by the at least one processor, further cause the at least one processor to select at least one of the scripts as a function of the tracked gaming activity of one of the players.

7. The gaming system of claim 6 wherein the plurality of instructions, when executed by the at least one processor, further cause the at least one processor to select at least one of the scripts as a function of the tracked gaming activity of one of the players on gaming machines beyond those in the linked gaming machines.

8. At least one non-transitory memory device that stores a plurality of instructions which, when executed by at least one processor, cause the at least one processor to:

initiate an instance of a bonus game common to a plurality of linked electronic gaming machines, the bonus game having sequential phases that follow one another and progress from an initial phase to a concluding phase in which a winner of the instance of the bonus game is designated;

display the bonus game on a video screen that is viewable by players of the linked electronic gaming machines;

select one of the players to play an initial phase of the instance of the bonus game;

enable the initial phase for play by only the one player at a first time;

run the initial phase according to a first script;

end the initial phase of the instance of the bonus game and suspend play of the bonus game;

permit play of the linked electronic gaming machines while play of the bonus game is suspended;

select only a different one of the players to play the second phase of the instance of the bonus game;

enable a second phase of the instance of the bonus game at a second time;

run the second phase according to a second script;

periodically enable additional phases of the instance of the bonus game for play of each additional phase by one player at a time;

run each phase according to a script until a game-concluding script running one of the phases results in an award;

give the award to the player playing the phase of the instance of the bonus game that is run by the game-concluding script; and end play of the instance of the bonus game when the phase run by the game-concluding script is concluded.

9. The at least one non-transitory memory device of claim 8 wherein the plurality of instructions which, when executed by at least one processor, further cause the at least one processor to prevent play of the instance of the bonus game by any players after each phase of the instance of the bonus game ends and before the next phase of the instance of the bonus game is enabled.

10. The at least one non-transitory memory device of claim 8 wherein gaming activity comprises operating parameters of a plurality of the gaming machines.

11. The at least one non-transitory memory device of claim 8 wherein gaming activity comprises player gaming history of a plurality of the players of the gaming machines.

12. The at least one non-transitory memory device of claim 8 wherein the award comprises an opportunity to play a game.

13. The at least one non-transitory memory device of claim 8 wherein the gaming activity further comprises gaming activity on gaming machines beyond those in the linked gaming machines.

14. The at least one non-transitory memory device of claim 8 wherein the plurality of instructions, when executed by the at least one processor, further cause the at least one processor to select at least one of the scripts as a function of the tracked gaming activity of one of the players.

15. The at least one non-transitory memory device of claim 8 wherein the plurality of instructions, when executed by the at least one processor, further cause the at least one processor to select at least one of the scripts as a function of the tracked gaming activity of one of the players on gaming machines beyond those in the linked gaming machines.

16. At least one non-transitory memory device that stores a plurality of instructions which, when executed by the at least one processor, cause the at least one processor to:

track gaming activity of a plurality of linked electronic gaming machines during multiple plays of at least two of the gaming machines;

establish at least one criterion related to the tracked gaming activity;

accumulate tracked gaming activity during the multiple plays;

associate an initial phase of an instance of a bonus game with a first player of one of the gaming machines;

enable the initial phase at a first time when the accumulated tracked gaming activity meets the at least one criterion;

display the instance of the bonus game on a video screen that is viewable by the players of the linked electronic gaming machines;

run the initial phase of the instance of the bonus game according to a first script;

permit only the first player to play the initial phase;

end the initial phase of the instance of the bonus game and suspend play of the instance of the bonus game;

continue to accumulate tracked gaming activity while play of the instance of the bonus game is suspended;

associate a second phase of the instance of the bonus game with a second player of one of the gaming machines, the second player being different from the first player;

enable the second phase at a second time after the first time when the accumulated tracked activity meets the at least one criterion;

permit only the second player to play the second phase;

run the second phase of the instance of the bonus game according to a second script;

periodically enable additional phases of the instance of the bonus game for play of each additional phase by one player at a time;

run each phase according to a script until a game-concluding script running one of the phases results in an award;

give the award to the player playing the phase of the instance of the bonus game that is run by the game-concluding script; and end play of the instance of the bonus game when the phase run by the game-concluding script is concluded.

17. The at least one non-transitory memory device of claim 16 wherein gaming activity comprises operating parameters of a plurality of the gaming machines.

18. The at least one non-transitory memory device of claim 16 wherein gaming activity comprises player gaming history of one of the players of the gaming machines on gaming machines beyond those in the linked gaming machines.

19. The at least one non-transitory memory device of claim 18 wherein the plurality of instructions, when executed by the at least one processor, further cause the at least one processor to select at least one of the scripts as a function of the tracked gaming activity of the player on gaming machines beyond those in the linked gaming machines.

20. The at least one non-transitory memory device of claim 16 wherein the plurality of instructions which, when executed by at least one processor, further cause the at least one processor to prevent play of the instance of the bonus game by any players after each phase of the instance of the bonus game ends and before the next phase of the instance of the bonus game is enabled.

* * * * *